US011077967B2

(12) United States Patent
Yokoo et al.

(10) Patent No.: US 11,077,967 B2
(45) Date of Patent: Aug. 3, 2021

(54) PAPER SHEET STORAGE MECHANISM, PAPER SHEET HANDLING MACHINE, AND PAPER SHEET STORAGE METHOD

(71) Applicant: GLORY LTD., Himeji (JP)

(72) Inventors: Tomohiro Yokoo, Hyogo (JP); Kazuhiko Takahashi, Hyogo (JP)

(73) Assignee: Glory Ltd., Himeji (JP)

( * ) Notice: Subject to any disclaimer, the term of this patent is extended or adjusted under 35 U.S.C. 154(b) by 504 days.

(21) Appl. No.: 15/553,789

(22) PCT Filed: Feb. 15, 2016

(86) PCT No.: PCT/JP2016/054280

§ 371 (c)(1),
(2) Date: Aug. 25, 2017

(87) PCT Pub. No.: WO2016/136517

PCT Pub. Date: Sep. 1, 2016

(65) Prior Publication Data

US 2018/0029730 A1 Feb. 1, 2018

(30) Foreign Application Priority Data

Feb. 26, 2015 (JP) ..... JP2015-037441

(51) Int. Cl.
*B65B 7/02* (2006.01)
*G07D 11/17* (2019.01)
(Continued)

(52) U.S. Cl.
CPC ..... *B65B 7/02* (2013.01); *B65B 51/146* (2013.01); *B65H 29/46* (2013.01); *B65H 31/02* (2013.01);
(Continued)

(58) Field of Classification Search
CPC .... G07D 11/13; G07D 11/16; G07D 2211/00; B65B 43/26
See application file for complete search history.

(56) References Cited

U.S. PATENT DOCUMENTS 4,687,462 A * 8/1987 Rewitzer ..... B65B 43/26 493/100
5,553,320 A * 9/1996 Matsuura ..... B65H 83/025 235/379
(Continued)

FOREIGN PATENT DOCUMENTS

EP 2 680 237 A1 1/2014
EP 2 736 025 A1 5/2014
(Continued)

OTHER PUBLICATIONS

European Search Report (Application No. 16755264.5—PCT/JP2016/054280) (8 pages—dated Sep. 25, 2018).
(Continued)

*Primary Examiner* — Anna K Kinsaul
*Assistant Examiner* — Daniel Jeremy Leeds
(74) *Attorney, Agent, or Firm* — Renner, Kenner, Greive, Bobak, Taylor & Weber; Edward Greive

(57) ABSTRACT

A paper sheet storage mechanism (e.g., a banknote storage mechanism 32) is provided with a pressing unit (e.g., pressing plate 46) which advances into a storage bag (e.g., banknote storage bag 34) held by a holding unit (e.g., holding member 36) and presses a portion of the storage bag from inside toward a placement unit (e.g., stage 40), thereby bringing a portion of the storage bag placed on the placement unit into a state in which paper sheets are stackable thereon. Before paper sheets are sent into the storage bag,
(Continued)

the pressing unit is caused to advance into the storage bag and press the portion of the storage bag toward the placement unit.

11 Claims, 14 Drawing Sheets

(51) Int. Cl.

| | |
|---|---|
| ***B65H 31/02*** | (2006.01) |
| ***G07D 9/00*** | (2006.01) |
| ***B65H 31/30*** | (2006.01) |
| ***B65H 29/46*** | (2006.01) |
| ***B65B 51/14*** | (2006.01) |
| ***B65H 31/34*** | (2006.01) |

(52) U.S. Cl.
CPC ..... *B65H 31/3018* (2013.01); *B65H 31/34* (2013.01); *G07D 9/00* (2013.01); *G07D 11/17* (2019.01); *B65H 2301/4212* (2013.01); *B65H 2301/422544* (2013.01); *B65H 2301/422548* (2013.01); *B65H 2701/1912* (2013.01)

(56) References Cited

U.S. PATENT DOCUMENTS

| | | | | |
|---|---|---|---|---|
| 6,244,589 | B1 * | 6/2001 | Gerlier | B65H 29/44 271/177 |
| 9,045,309 | B2 * | 6/2015 | Hashimoto | B65H 31/22 |
| 9,466,167 | B2 * | 10/2016 | Razzaboni | B65B 25/14 |
| 10,169,944 | B2 * | 1/2019 | Razzaboni | G07D 11/0096 |

FOREIGN PATENT DOCUMENTS

| | | | |
|---|---|---|---|
| JP | 2007-161319 | A | 6/2007 |
| JP | 2008-171334 | A | 7/2008 |
| JP | 2012-174130 | A | 9/2012 |
| WO | WO 2014/181290 | A1 | 11/2014 |

OTHER PUBLICATIONS

Written Opinion of the International Searching Authority (International Application No. PCT/JP2016/054280) 4 pages—dated Mar. 22, 2016).

Extended European Search Report (Application No. 16 755 264. 5—PCT/JP2016/054280) (7 pages—dated May 31, 2019).

* cited by examiner

PAPER SHEET STORAGE MECHANISM, PAPER SHEET HANDLING MACHINE, AND PAPER SHEET STORAGE METHOD

TECHNICAL FIELD

The present invention relates to: a paper sheet storage mechanism for storing paper sheets, such as banknotes, in a storage bag such as a pouch having an opening at one end thereof; a paper sheet handling machine equipped with the paper sheet storage mechanism; and a paper sheet storage method using the paper sheet storage mechanism.

BACKGROUND ART

Some conventional paper sheet handling machines performing depositing of paper sheets such as banknotes are configured to store paper sheets taken therein into storage bags such as pouches. Such a paper sheet handling machine is disclosed in Japanese Laid-Open Patent Publication No. 2012-174130, for example. According to Japanese Laid-Open Patent Publication No. 2012-174130, such a paper sheet handling machine is used as a part of a cash teller machine (specifically, a banknote teller machine) provided in a back office area of a store such as a supermarket, for example. The cash teller machine discharges money as change funds to be charged in a cash checkout machine provided in a front, customer facing, area of the store, and receives money as sales proceeds collected from the cash checkout machine.

In such a paper sheet handling machine, a banknote storage mechanism as disclosed in, for example, European Patent Publication EP2736025A1 is used for storing banknotes into storage bags such as pouches. In the mechanism disclosed in European Patent Publication EP2736025A1, a pouch with an opening being open, is held by a pair of bar-like holding members at portions near the opening thereof. A portion of the pouch is then inserted through an opening of a vertically movable platform positioned below the holding members. A portion of the pouch positioned below the platform is narrowed while a portion of the pouch positioned above the platform is spread on an upper surface of the platform, so that banknotes can be easily stacked in the pouch.

SUMMARY OF THE INVENTION

In the mechanism disclosed in European Patent Publication EP2736025A1, however, the bottom portion of the pouch positioned above the platform is not formed in a flat shape, but is merely spread out on the upper surface of the platform. Therefore, when banknotes are stored in the pouch, the banknotes stacked on the bottom portion of the pouch are tilted with respect to the horizontal direction, which makes the stacked state of the banknotes in the pouch unstable.

The present invention is made in view of such circumstances, and an object of the present invention is to provide a paper sheet storage mechanism, a paper sheet handling machine, and a paper sheet storage method, which are able to prevent paper sheets stacked on a bottom portion of a storage bag from tilting with respect to the horizontal direction when the paper sheets are stored in the storage bag, whereby the stacked state of the paper sheets in the storage bag can be made stable.

A paper sheet storage mechanism according to a first aspect of the invention is a paper sheet storage mechanism for storing paper sheets in a storage bag having an opening at one end thereof. The paper sheet storage mechanism comprises: a holding unit configured to hold a portion of the storage bag, near the opening; a paper sheet sending unit configured to send paper sheets into the storage bag held by the holding unit; a placement unit movable in a substantially vertical direction, on which at least a portion of the storage bag held by the holding unit is placed; a pressing unit configured to advance into the storage bag and press a portion of the storage bag from inside towards the placement unit, thereby bringing the portion of the storage bag placed on the placement unit into a state in which paper sheets are stackable thereon; a driving unit configured to drive the pressing unit; and a control unit configured to control the driving unit so that the pressing unit advances into the storage bag held by the holding unit and presses the portion of the storage bag toward the placement unit before the paper sheets are sent into the storage bag by the paper sheet sending unit.

The paper sheet storage mechanism may further include an escrow unit configured to temporarily keep in escrow the paper sheets sent from the paper sheet sending unit before they are stored in the storage bag. The control unit may control the driving unit so that the pressing unit pushes the paper sheets temporarily escrowed on the escrow unit into the storage bag.

The control unit may control the driving unit so that the pressing unit advances into the storage bag and presses the portion of the storage bag towards the placement unit via the paper sheets stacked in the storage bag.

The control unit may subsequently control the placement unit to move upwards.

When the pressing unit advances into the storage bag held by the holding unit and presses the portion of the storage bag from inside toward the placement unit, the portion of the storage bag may be sandwiched between the pressing unit and the placement unit.

Alternatively, when the pressing unit advances into the storage bag held by the holding unit and presses the portion of the storage bag from inside toward the placement unit, a small gap may be formed between the pressing unit and the placement unit.

The holding unit may include a first heating member configured to seal, by thermal adhesion, the portion of the storage bag, near the opening, that is held by the holding unit.

The pressing unit may include a plurality of pressing parts, and the respective pressing parts, after advancing into the storage bag held by the holding unit, may be spreadable within the storage bag, thereby bringing the portion of the storage bag placed on the placement unit into a state in which paper sheets are stackable thereon.

The placement unit may have an opening through which a portion of the storage bag whilst held by the holding unit is inserted.

Alternatively, the placement unit may include a plurality of placement parts, and each of the placement parts may be movable in a direction towards and away from the other placement parts. The pressing unit may advance into the storage bag and press the storage bag from inside toward the placement parts, with a portion of the storage bag being positioned in a gap between spaced apart placement parts, thereby bringing the portion of the storage bag placed on the placement unit into a state in which paper sheets are stackable thereon.

In this case, before causing the pressing unit to advance into the storage bag, the control unit may cause the placement parts to move towards each other as the portion of the storage bag is positioned between the spaced apart placement parts, thereby sandwiching the portion of the storage bag between the placement parts.

At least one of the placement parts may include a second heating member configured to seal, by thermal adhesion, a portion of the storage bag, near the placement unit.

A paper sheet handling machine according to a second aspect of the invention is a paper sheet handling machine configured to handle paper sheets, and includes: a paper sheet storage mechanism for storing paper sheets in a storage bag having an opening at one end thereof; a main body configured to send the paper sheets to the paper sheet storage mechanism; and a control unit. The paper sheet storage mechanism includes: a holding unit configured to hold a portion of the storage bag near the opening; a placement unit movable in a substantially vertical direction, on which at least a portion of the storage bag is placed; a pressing unit configured to advance into the storage bag held by the holding unit and press a portion of the storage bag from inside toward the placement unit, thereby to bring the portion of the storage bag placed on the placement unit into a state where paper sheets are stackable thereon; and a driving unit configured to drive the pressing unit. The control unit controls the driving unit so that the pressing unit advances into the storage bag held by the holding unit and presses the portion of the storage bag toward the placement unit before paper sheets are sent from the main body into the storage bag.

A paper sheet storage method according to a third aspect of the invention is a method for storing paper sheets in a storage bag having an opening at one end thereof. The method includes the steps of: causing a holding unit to hold a portion of the storage bag near the opening; before sending paper sheets into the storage bag held by the holding unit, causing a pressing unit to advance into the storage bag held by the holding unit and press a portion of the storage bag towards a placement unit on which at least a portion of the storage bag is placed, thereby bringing the portion of the storage bag placed on the placement unit into a state in which paper sheets are stackable thereon; and subsequently sending paper sheets into the storage bag.

DESCRIPTION OF EMBODIMENTS

Figure 1:
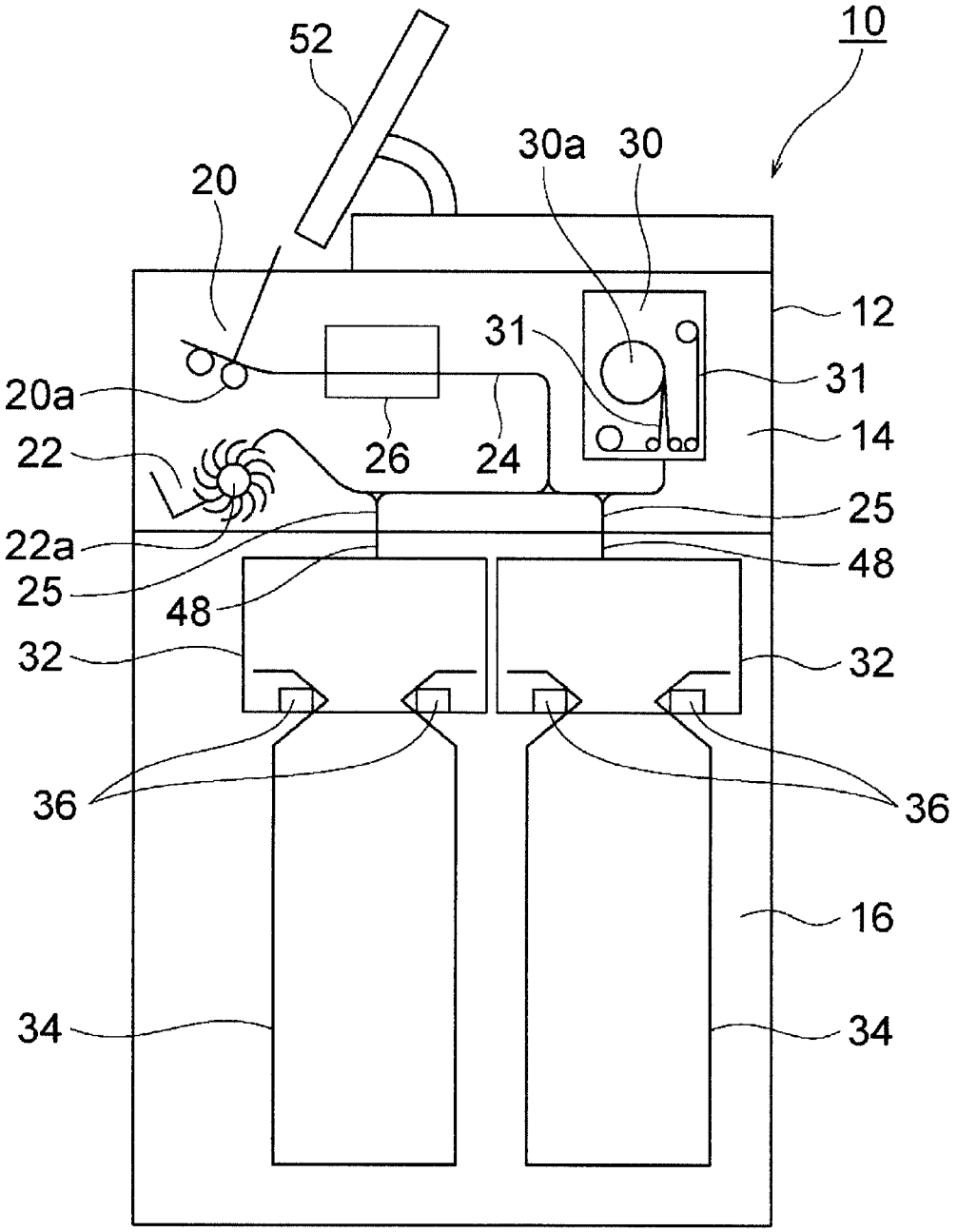
FIG. 1 is a schematic diagram illustrating an example of the structure of a banknote handling machine according to an embodiment of the present embodiment.
Figure 2:
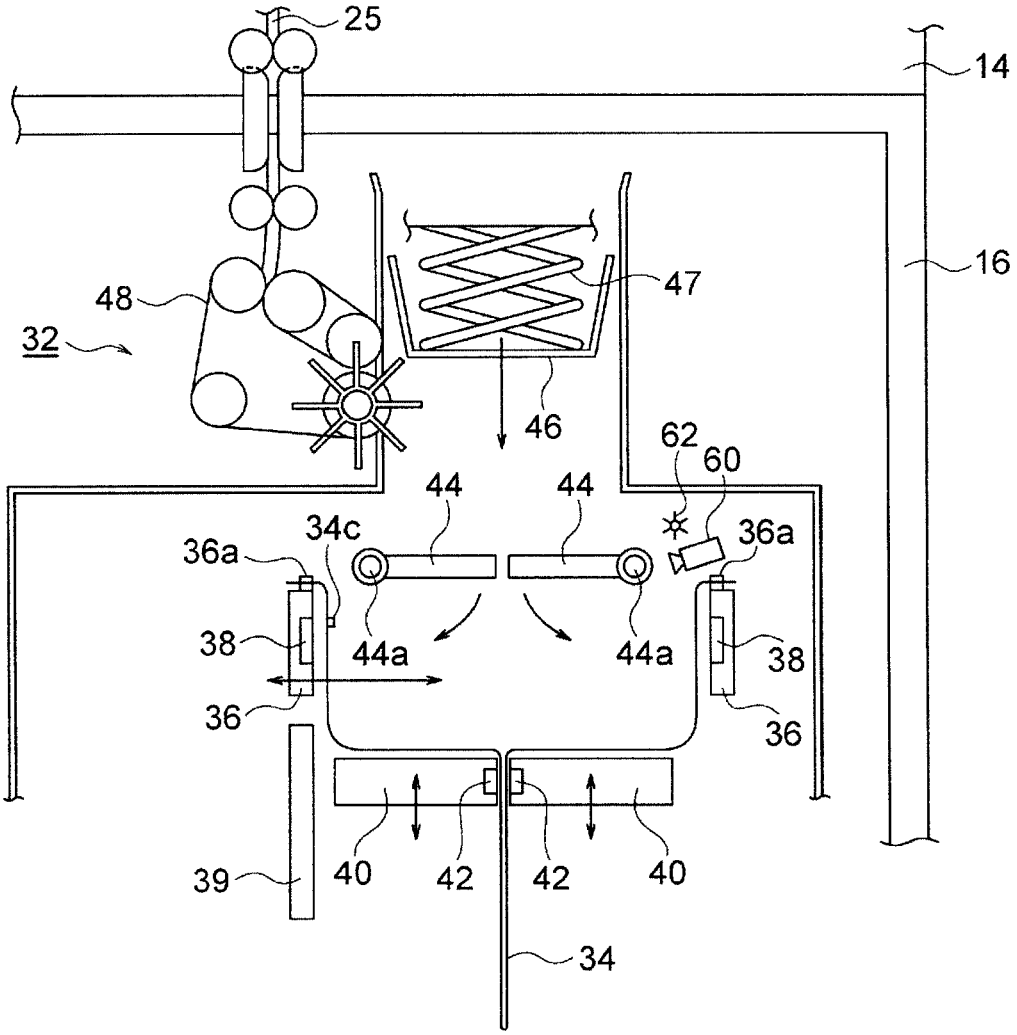
FIG. 2 is a side view illustrating, in detail, the structure of a banknote storage mechanism included in the banknote handling machine shown in FIG. 1.
Figure 3:
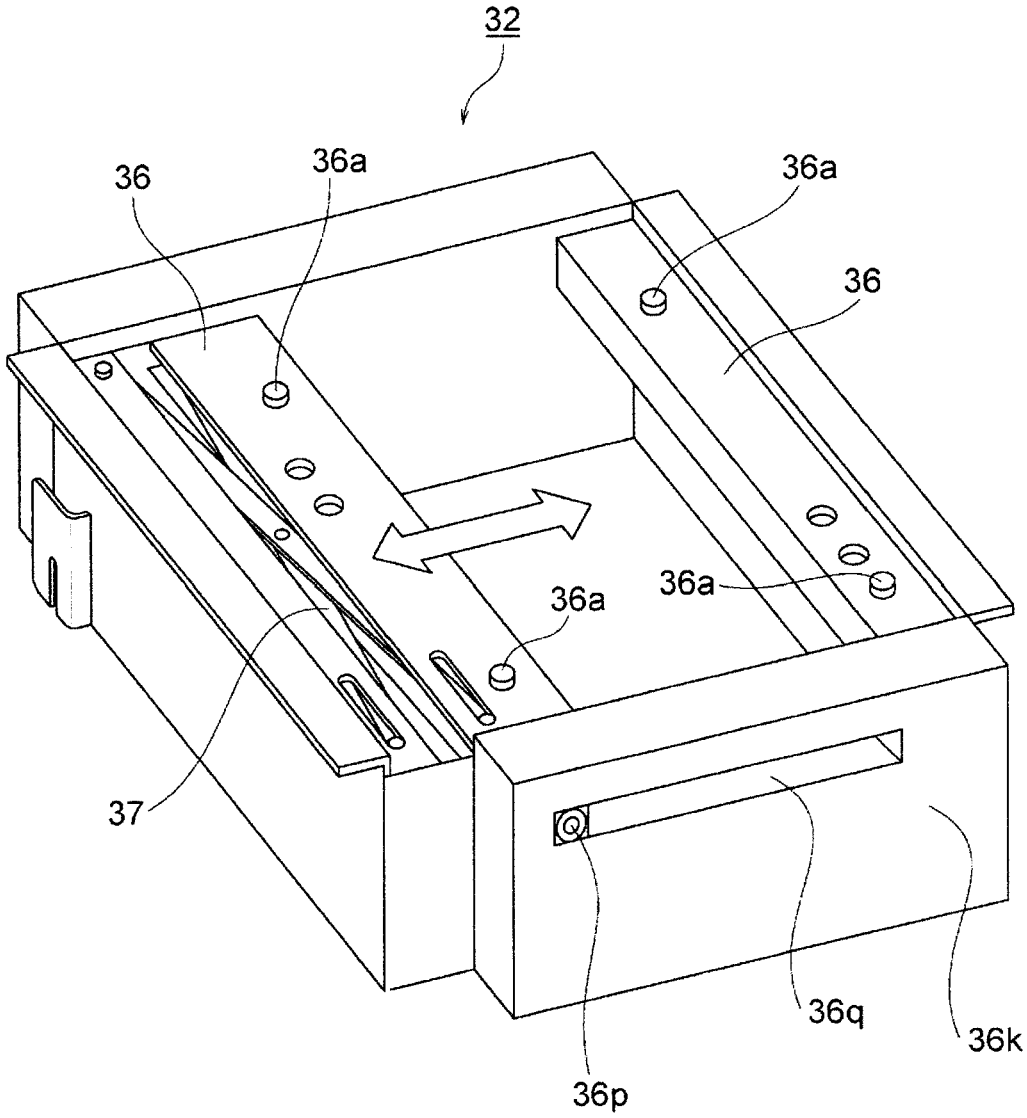
FIG. 3 is a perspective view illustrating components, such as a pair of holding members, of the banknote storage mechanism shown in FIG. 2.
Figure 4:
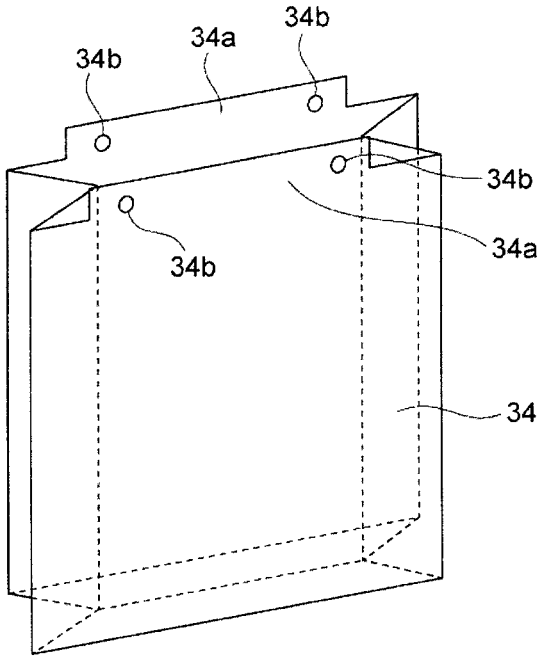
FIG. 4 is a perspective view illustrating the structure of a banknote storage bag to be held by the respective holding members in the banknote storage mechanism shown in FIG. 2, etc.
Figure 5:
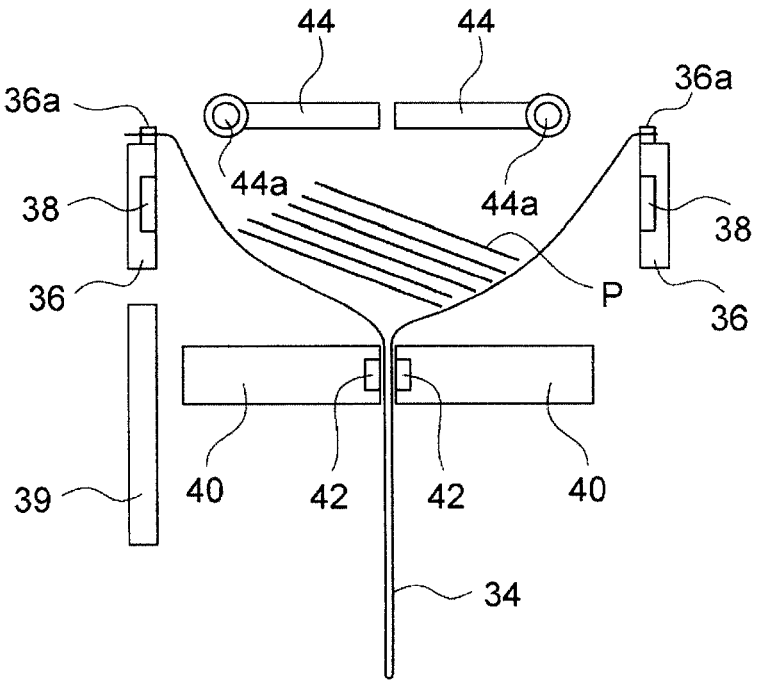
FIG. 5 is a side view illustrating a state where banknotes are stored in the banknote storage bag before a bottom portion of the banknote storage bag is pressed from inside by a pressing plate, in the banknote storage mechanism shown in FIG. 2 etc.
Figure 8:
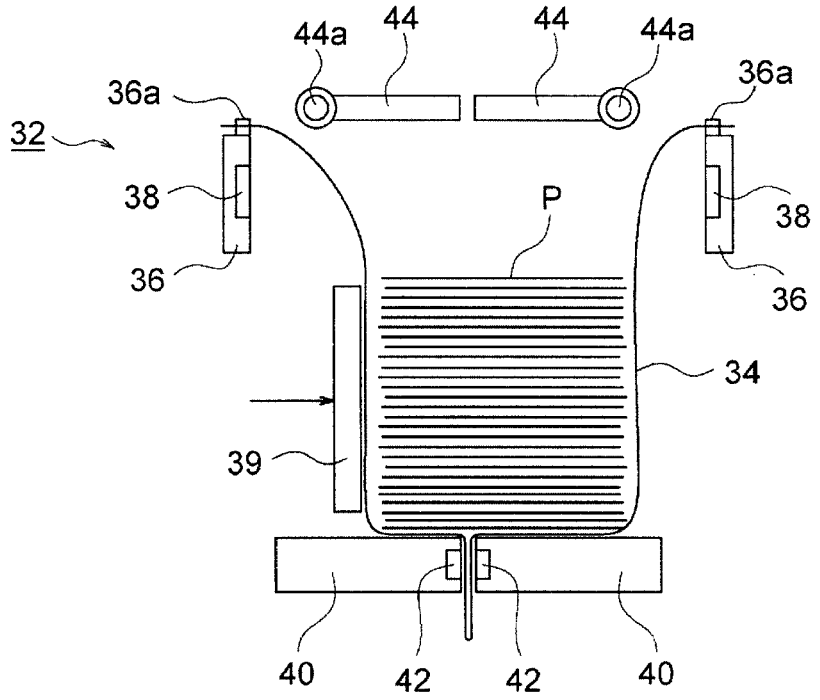
FIG. 8 is a side view, subsequent to the state shown in FIG. 7, illustrating an operation of storing banknotes in the banknote storage bag in the banknote storage mechanism shown in FIG. 2, etc.
Figure 9:
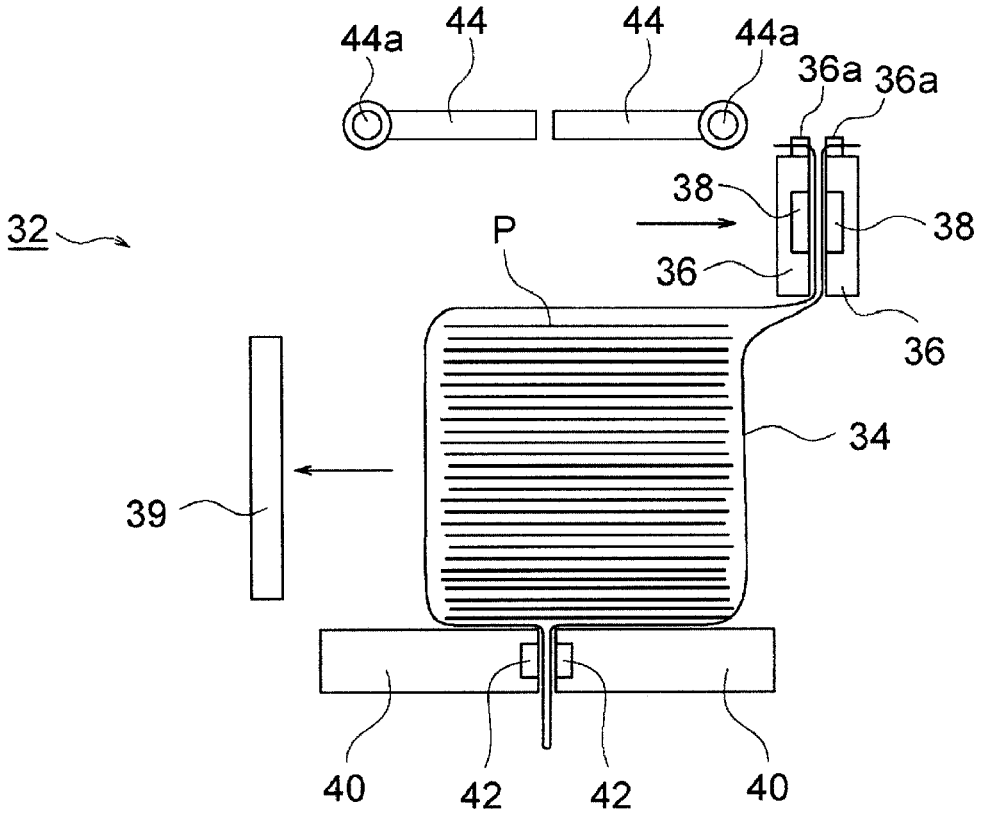
FIG. 9 is a side view, subsequent to the state shown in FIG. 8, illustrating an operation of taking out the banknote storage bag from the banknote storage mechanism shown in FIG. 2, etc.
Figure 10:
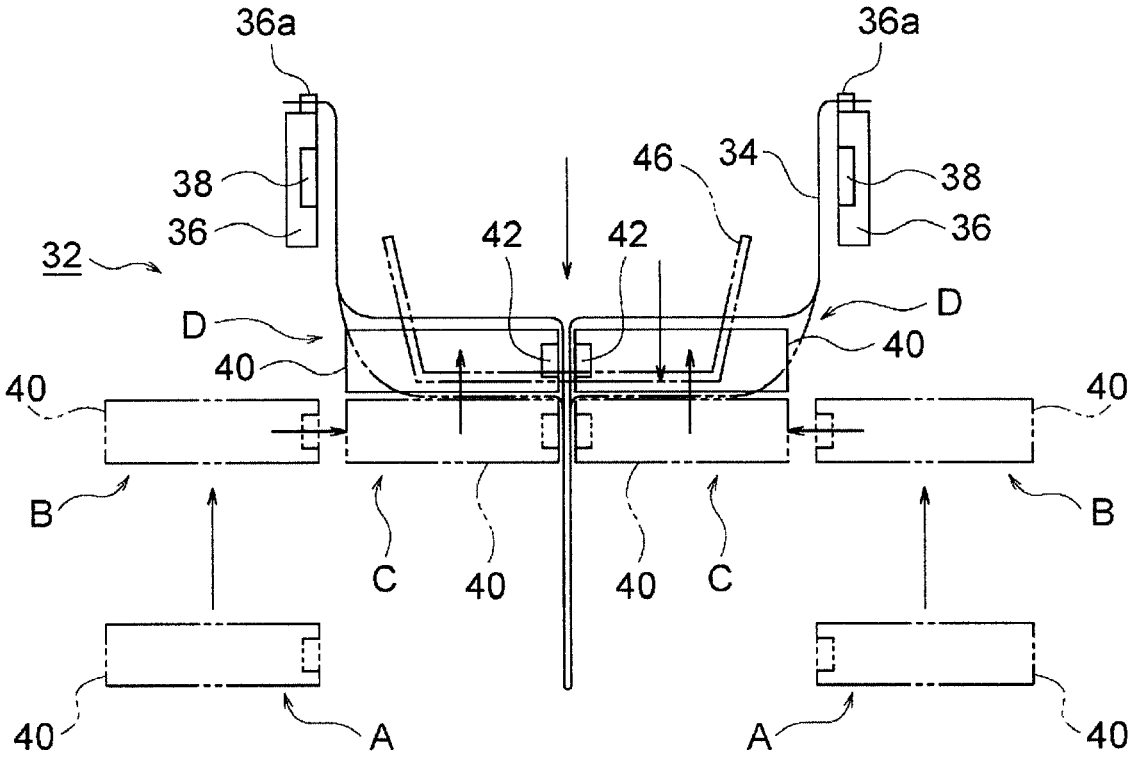
FIG. 10 is a side view illustrating an operation of a stage before the bottom portion of the banknote storage bag is pressed from inside by the pressing plate in the banknote storage mechanism shown in FIG. 2, etc.
Figure 11:
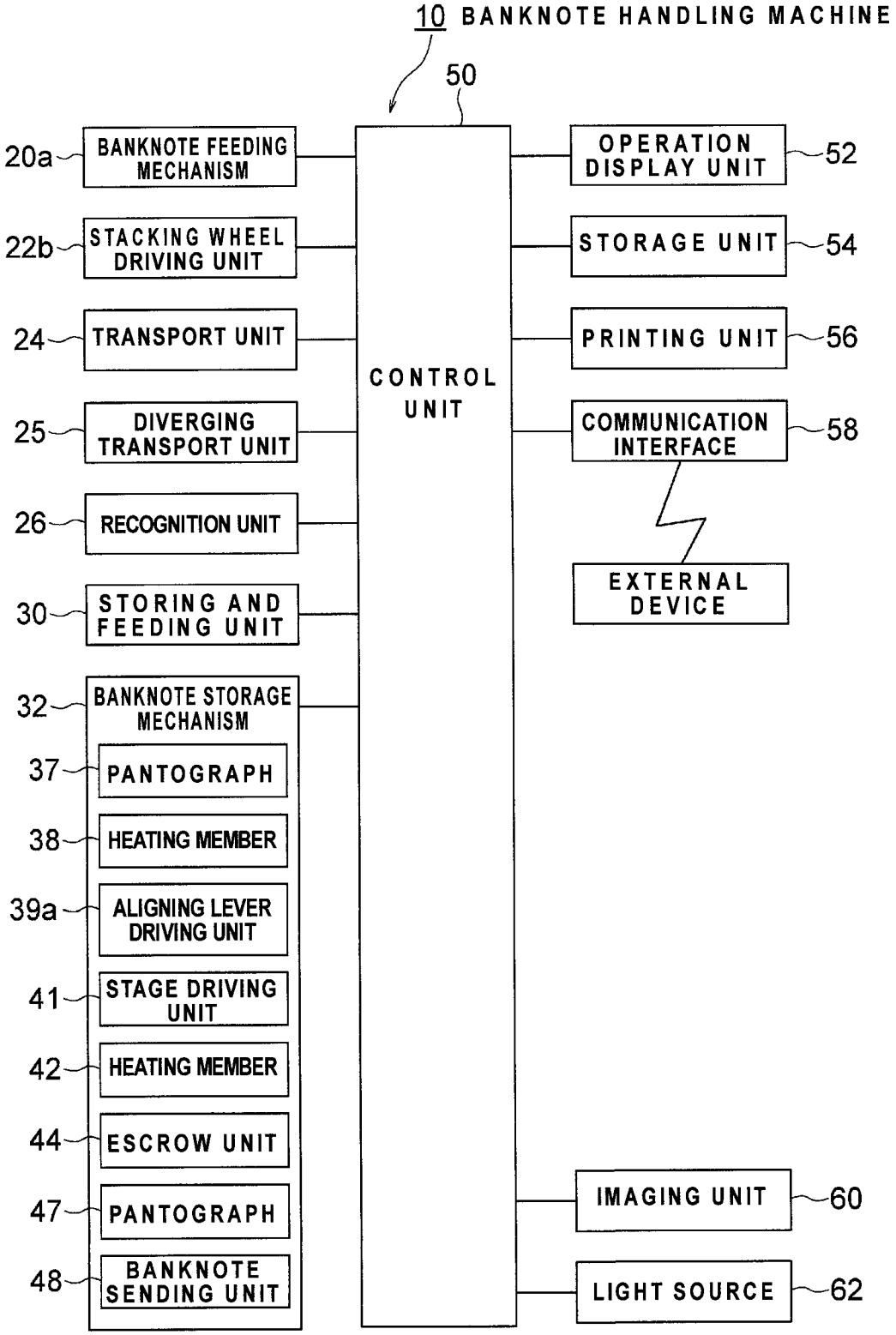
FIG. 11 is a functional block diagram illustrating the structure of a control system of the banknote handling machine shown in FIG. 1, etc.

Hereinafter, embodiments of the present invention will be described with reference to the drawings. FIGS. 1 to 11 illustrate a banknote handling machine and a banknote handling method according to the invention. FIG. 1 is a schematic diagram illustrating an example of the structure of the banknote handling machine according to the invention. FIG. 2 is a side view illustrating, in detail, the structure of a banknote storage mechanism included in the banknote handling machine shown in FIG. 1. FIG. 3 is a perspective view illustrating components, such as a pair of holding members, of the banknote storage mechanism shown in FIG. 2. FIG. 4 is a perspective view illustrating the structure of a banknote storage bag to be held by the respective holding members in the banknote storage mechanism shown in FIG. 2, etc. FIG. 5 is a side view illustrating a state where banknotes are stored in the banknote storage bag before a bottom portion of the banknote storage bag is pressed from inside by a pressing plate in the banknote storage mechanism shown in FIG. 2 etc. FIGS. 6 to 9 are side views illustrating, in order, operations for storing banknotes in the banknote storage bag after the bottom portion of the banknote storage bag has been pressed from inside by the pressing plate in the banknote storage mechanism shown in FIG. 2, etc. FIG. 10 is a side view illustrating an operation of a stage before the bottom portion of the banknote storage bag is pressed from inside by the pressing plate in the banknote storage mechanism shown in FIG. 2, etc. FIG. 11 is a functional block diagram illustrating the structure of a control system of the banknote handling machine shown in FIG. 1, etc.

In general, the banknote handling machine 10 according to the invention is provided in a front, customer facing, area or a back office area of a store such as a supermarket, or in a lobby, or in an office area of a bank. The banknote handling machine 10 is able to perform various kinds of handling such as the deposit of banknotes. As shown in FIG. 1, the banknote handling machine 10 has a housing 12 having a substantially rectangular shape. A left-side face of the housing 12 in FIG. 1 is a front face of the housing 12 (i.e., a face to which an operator opposes). An upper unit 14 and a lower unit 16 are slidably mounted in the housing 12 so as to be drawable frontward (specifically, leftward in FIG. 1) through the front face of the housing 12. An insertion unit 20, such as a receiving hopper for inserting banknotes into the housing 12 from the outside thereof, is provided in the upper unit 14, and more specifically, in a front-side upper portion of the housing 12 (a left-side upper portion in FIG. 1). Also, a discharge unit 22 for discharging banknotes from the inside of the housing 12 to the outside thereof is provided in the upper unit 14, and more specifically, below the insertion unit 20 at the front face of the housing 12 (the left-side face in FIG. 1).

The insertion unit 20 is provided with a banknote feeding mechanism 20*a* for feeding banknotes placed in a stacked state in the insertion unit 20 by an operator, one by one, into the housing 12. In the upper unit 14, a primary transport unit 24 for transporting banknotes one by one into the housing 12 is provided, and the banknotes fed from the insertion unit 20 by the banknote feeding mechanism 20*a* are transported one by one by the primary transport unit 24. The primary transport unit 24 is provided with a recognition unit 26. The recognition unit 26 recognizes the denomination, authenticity, face/back, fitness, version, transported state, and the like of each of the banknotes fed to the primary transport unit 24 by the banknote feeding mechanism 20*a*. The recognition unit 26 includes, for example, an image sensor, and an image of each banknote is captured by the image sensor. On the basis of the image of each banknote captured by the image sensor, the recognition unit 26 is able to obtain information such as the serial number of the banknote, type (series) of the banknote, and year of issuance of the banknote, etc.

As shown in FIG. 1, the discharge unit 22 is connected to the primary transport unit 24, and the banknotes transported from the primary transport unit 24 towards the discharge unit 22 are stacked in the discharge unit 22. The discharge unit 22 is accessible from the outside of the housing 12, and an operator is able to take out the banknotes stacked in the discharge unit 22 from the front face of the housing 12. A stacking wheel 22*a* is provided at an intersection of the transport unit 24 with the discharge unit 22. The stacking wheel 22*a* rotates counterclockwise in FIG. 1. When the banknotes are transported by the primary transport unit 24 to the discharge unit 22, the stacking wheel 22*a* rotates with each banknote being received between two blades of the stacking wheel 22*a*, the banknote consequently being stacked in an aligned state within the discharge unit 22.

In the upper unit 14, the transport unit 24 is provided with a tape-type storing and feeding unit 30. The banknotes transported by the primary transport unit 24 to the storing and feeding unit 30 are stored in the storing and feeding unit 30, and the banknotes stored in the storing and feeding unit 30 are fed one by one to the transport unit 24. More specifically, the storing and feeding unit 30 is provided with a drum 30*a* that is rotatable in both the forward direction and the reverse direction, and one end each of a pair of strip-like tapes 31 are connected to an outer peripheral surface of the drum 30*a*. When the banknotes have been transported from the primary transport unit 24 to the storing and feeding unit 30, the banknotes are wound one by one onto the drum 30*a* together with the strip-like tapes 31. When the tapes 31 are unwound from the drum 30*a* by rotating the drum 30*a* in the reverse direction, the banknotes stored on the drum 30*a* are released from between the tapes 31 and fed to the transport unit 24.

In the first embodiment, as shown in FIG. 1, the lower unit 16 is provided with a plurality of (i.e. two or more) banknote storage mechanisms 32 for storing banknotes into banknote storage bags 34, each having an opening at one end thereof. Each banknote storage mechanism 32 is provided with a pair of first and second holding members 36 which are spaced apart from and opposed to each other. Two opposing portions of the banknote storage bag 34, near the opening, are held by the respective first and second holding members 36. The position of the first holding member 36 (specifically, the right-side holding member 36 in FIG. 1 or FIG. 2) is fixed while the second holding member 36 (specifically, the left-side holding member 36 in FIG. 1 or FIG. 2) is movable toward the first holding member 36. As shown in FIG. 2, each first and second holding member 36 is provided with a heating member 38. In the banknote storage mechanism 32, after a predetermined amount of banknotes have been stored in the banknote storage bag 34, before the banknote storage bag 34 is taken out of the banknote storage mechanism 32, the second holding member 36 is moved toward the first holding member 36, and heat is applied by the first and second heating members 38 to the portions near the opening of the banknote storage bag 34 with the holding members 36 being joined to each other, whereby the opening of the banknote storage bag 34 is heat-sealed. In the banknote storage mechanism 32, instead of moving the second holding member 36 toward the first holding member 36, both first and second holding members 36 may be moved towards each other to reach an intermediate position therebetween, and meet at the intermediate position.

In the upper unit 14, a plurality of (two are shown in the example of FIG. 1) secondary transport units 25, corresponding to the number of respective banknote storage mechanisms 32, branch off from the primary transport unit 24. Banknotes diverted from the primary transport unit 24 to each secondary transport unit 25 are transported to the banknote storage bag 34 attached to the corresponding banknote storage mechanism 32 and are stored in the banknote storage bag 34.

Next, the structure of the banknote storage mechanism 32 according to the first embodiment will be described in detail with reference to FIGS. 2 to 4. FIG. 2 is a side view illustrating the structure of the banknote storage mechanism 32 in detail. FIG. 3 is a perspective view illustrating the components such as the pair of first and second holding members 36 included in the banknote storage mechanism 32 shown in FIG. 2. FIG. 4 is a perspective view illustrating the structure of the banknote storage bag 34 to be held by the holding members 36 in the banknote storage mechanism 32 shown in FIG. 2, etc.

As shown in FIG. 2, the banknote storage mechanism 32 is provided with: a banknote sending unit 48 for sending banknotes transported by the secondary transport unit 25 from the upper unit 14 to the lower unit 16, toward the banknote storage bag 34 held by the pair of holding members 36; an escrow unit 44 on which the banknotes sent from the banknote sending unit 48 are temporarily escrowed; and a stage element 40 on which a bottom portion of the banknote storage bag 34, whilst held by the pair of holding members 36, is placed.

As shown in FIG. 2, the banknote sending unit 48 is composed of a combination of rollers and belts. The banknote sending unit 48 sends, one by one, the banknotes transported by the secondary transport unit 25 from the upper unit 14 to the lower unit 16, onto the escrow unit 44 so that the banknotes are stacked on the escrow unit 44. The escrow unit 44 is composed of a pair of right and left escrow units, and each escrow unit 44 is pivotable downward (i.e., in a direction indicated by an arrow in FIG. 2) about a shaft 44*a* provided at one end of the escrow unit 44. The stage element 40 is composed of a pair of right and left stages 40, and each stage 40 is movable in the up-down direction and the right-left direction in FIG. 2. A gap is formed between the pair of stages 40, and a portion of the banknote storage bag 34 passes through this gap and extends downward between the stages 40. Each stage 40 is driven by a stage driving unit 41 (refer to FIG. 11), such as an electric actuator.

As shown in FIG. 2, each stage 40 is provided with a heating member 42. Before the banknote storage bag 34 is taken out of the banknote storage mechanism 32, one of the stages 40 (e.g., the left-side stage 40 in FIG. 2) is moved toward the other stage 40 (e.g., the right-side stage 40 in FIG. 2), and heat is applied by the heating members 42 to a portion, near the bottom portion, of the banknote storage bag 34 with the stages 40 abutting one another, to cause the bottom portion of the banknote storage bag 34 to be heat-sealed. In the banknote storage mechanism 32, instead of moving one of the stages 40 toward the other stage 40, both stages 40 may be moved towards each other to reach an intermediate position therebetween, and meet at the intermediate position.

As shown in FIG. 3, the left-side holding member 36 of the pair of right and left holding members 36 is provided with a pantograph 37. The left-side holding member 36 is moved toward the right-side holding member 36 by the pantograph 37 so that these holding members 36 abut one another. More specifically, a guide pin 36*p* is provided on an end portion of the left-side holding member 36, and a frame 36*k* supporting the holding members 36 has a elongate slot 36*q* in which the guide pin 36*p* is guided. The elongate slot 36*q* is extends in the horizontal direction in the frame 36*k*. When the pantograph 37 is expanded, the guide pin 36*p* provided on the left-side holding member 36 is guided along the elongate slot 36*q*, such that the left-side holding member 36 is moved toward the right-side holding member 36.

As shown in FIG. 3, two pins 36*a* are provided on each of the upper surfaces of the pair of right and left holding members 36. As shown in FIG. 4, the banknote storage bag 34 to be held by the holding members 36 has a pair of projecting portions 34*a* at positions near the opening thereof (i.e., at an upper end of the banknote storage bag 34). Each projecting portion 34*a* has two holes 34*b*. When the banknote storage bag 34 is set and held by the holding members 36, the pins 36*a* of the holding members 36 stick through the holes 34*b* provided in the projecting portions 34*a* of the banknote storage bag 34, whereby these projecting portions 34*a* are held by the holding members 36.

As shown in FIG. 2, a pressing plate 46 is provided above the pair of escrow units 44. The pressing plate 46 is also provided with a pantograph 47. As the pantograph 47 expands downwardly, it causes the pressing plate 46 to move downwards from the state shown in FIG. 2. When the banknotes temporarily escrowed on the escrow units 44 are to be stored in the banknote storage bag 34, the pressing plate 46, moving downwards from the state shown in FIG. 2, pushes banknotes remaining on the escrow units 44 toward the banknote storage bag 34.

As shown in FIG. 2, an aligning lever 39 is provided below the left-side holding member 36 of the pair of holding members 36. Using the aligning lever 39, banknotes stored in the banknote storage bag 34 are aligned to one side (specifically, to the right in FIG. 2) in the banknote storage bag 34. More specifically, the aligning lever 39 is movable to the right from the state shown in FIG. 2 by an aligning lever driving unit 39*a* (refer to FIG. 11) implemented by a pantograph, an electric actuator, or the like. The technical feature of the aligning lever 39 will be described later in detail.

In the banknote storage mechanism 32, an imaging unit 60, such as a camera for taking an image of an inner wall portion of the banknote storage bag 34, is provided near the opening of the banknote storage bag 34. A marker 34*c* is provided on the inner wall portion, near the opening, of the banknote storage bag 34 held by the holding members 36, and the imaging unit 60 takes an image of the marker 34*c*. A light source 62 for applying light to the inner wall portion of the banknote storage bag 34 is provided near the imaging unit 60. The light source 62 shines light on the inner wall portion of the banknote storage bag 34 such that the imaging unit 60 can take a clear image of the marker 34*c*.

The banknote handling machine 10 is provided with a control unit 50 for controlling the respective components of the banknote handling machine 10. More specifically, as shown in FIG. 11, the components in communication with the control unit 50 are as follows: the banknote feeding mechanism 20*a* provided in the insertion unit 20; a stacking wheel driving unit 22*b* for driving the stacking wheel 22*a* provided in the discharge unit 22; the primary transport unit 24; the secondary transport units 25; the recognition unit 26; the storing and feeding unit 30; the banknote storage mechanism 32 (specifically, the pantograph 37, the heating members 38, the aligning lever driving unit 39*a*, the stage driving unit 41, the heating members 42, the escrow units 44, the pantograph 47, and the banknote sending unit 48); the imaging unit 60; the light source 62; and the like. A signal regarding a banknote recognition result obtained by the recognition unit 26 and/or an image taken by the imaging unit 60 are transmitted to the control unit 50, and the control unit 50 transmits instruction signals to the respective components of the banknote handling machine 10 to control the operations of these components.

As shown in FIG. 11, an operation display unit 52, a storage unit 54, a printing unit 56, and a communication interface 58 are in communication with the control unit 50. As shown in FIG. 1, the operation display unit 52 is implemented by, for example, a touch panel provided on an upper face of the housing 12. The operation display unit 52 displays information concerning the state of handling such as depositing of banknotes, an inventory amount of banknotes stored in each banknote storage bag 34, and/or the like in the banknote handling machine 10. An operator is able to give various instructions to the control unit 50 by operating the operation display unit 52. For example, the operator is able to select a banknote sorting pattern to the plurality of banknote storage bags 34 by using the operation display unit 52. The operator may set any banknote sorting pattern to the plurality of banknote storage bags 34 by using the operation display unit 52, or may select one of many preset banknote sorting patterns.

The storage unit 54 stores, therein, information concerning the history of handling such as depositing of banknotes, an inventory amount of banknotes stored in each banknote storage bag 34, and/or the like in the banknote handling machine 10. The storage unit 54 also stores, therein, recognition information of banknotes recognized by the recognition unit 26. Specifically, identification information (ID) of each banknote storage bag 34 and identification information of banknotes stored in the banknote storage bag 34 are associated with each other and stored in the storage unit 54. The printing unit 56 prints, on a receipt or the like, the information concerning the history of handling such as depositing of banknotes, the inventory amount of banknotes stored in each banknote storage bag 34, and/or the like in the banknote handling machine 10. Further, the control unit 50 is configured to transmit/receive a signal to/from an external device (specifically, a higher-ranking terminal, for example) provided separately from the banknote handling machine 10, via the communication interface 58. Specifically, the control unit 50 is configured to transmit the information stored in the storage unit 54 via the communication interface 58 to the external device provided separately from the banknote handling machine 10. For example, when staff of an armored car service or the like collects the banknotes together with the banknote storage bag 34, information concerning the collected banknotes is transmitted to a computer or the like of the armored car service via the communication interface 58.

The control unit 50 described above is provided in the housing 12 of the banknote handling machine 10 to control the respective components of the banknote handling machine 10. However, when the banknote storage mechanism 32 is used alone, a control unit for controlling the components of the banknote storage mechanism 32 may be provided in the banknote storage mechanism 32.

Next, the operation of the banknote handling machine 10 having the above-described structure will be described. The operation of the banknote handling machine 10 as described below is performed by the control unit 50 controlling the respective components of the banknote handling machine 10.

First, the operation of the banknote handling machine 10 for the deposits of banknotes will be described. After inserting banknotes into the insertion unit 20, an operator gives a deposit start instruction to the control unit 50 by using the operation display unit 52. Then, the banknotes inserted into the insertion unit 20 are fed one by one into the housing 12 by the banknote feeding mechanism 20*a*, and transported one by one by the primary transport unit 24. Then, the denomination, authenticity, face/back, fitness, version, transported state, and the like of each of the banknotes transported by the transport unit 24 are recognized by the recognition unit 26. In addition, an image of each banknote is taken by the image sensor of the recognition unit 26, and information such as the serial number of the banknote, type (series) of the banknote, year of issuance of the banknote, and the like is obtained on the basis of the image of the banknote. A banknote recognized by the recognition unit 26 as not being a normal banknote, that is, a rejected note, is transported to the discharge unit 22 by the primary transport unit 24, and stacked in the discharge unit 22. Thus, the operator is able to manually take out the rejected banknote stacked in the discharge unit 22 from the front face of the housing 12, and insert the banknote into the insertion unit 20 again.

Meanwhile, a banknote recognized as being a normal banknote by the recognition unit 26 is diverted from the primary transport unit 24 to the secondary transport unit 25, transported by the secondary transport unit 25 to the banknote storage bag 34, and stored in the banknote storage bag 34. The control unit 50 controls the primary transport unit 24 so that the banknotes transported by the primary transport unit 24 from the upper unit 14 to the lower unit 16 are sorted and stored in the respective banknote storage bags 34 on the basis of predetermined sorting conditions set in advance.

If the banknote storage bag 34 to which a banknote recognized by the recognition unit 26 should be transported is in a full state or a near-full state and as a consequence the banknote cannot be stored in the banknote storage bag 34, the banknote recognized by the recognition unit 26 is transported to the storing and feeding unit 30 and stored in the storing and feeding unit 30. When the banknote storage bag 34 in the full state or the near-full state has been taken out of the banknote storage mechanism 32 from the lower unit 16 and an empty banknote storage bag 34 attached to the banknote storage mechanism 32 by, for example, staff of an armored car service or a clerk of a store, banknotes stored in the storing and feeding unit 30 are fed one by one to the primary transport unit 24, and transported to the banknote storage bag 34 using the primary transport unit 24.

Various conditions are conceivable as predetermined sorting conditions for sorting and transporting, to the respective banknote storage bags 34, the banknotes transported from the upper unit 14 to the lower unit 16. An example of a predetermined sorting condition may be a condition of sorting into banknotes to be used as, for example, change funds on the next day in a store where the banknote handling machine 10 is provided, and banknotes to be collected by a staff of an armored car service or the like. In this case, a banknote which has been recognized by the recognition unit 26 and determined by the control unit 50 as being a banknote to be used as change funds on the next day in the store where the banknote handling machine 10 is provided, this banknote is transported by the primary transport unit 24 to the left-side banknote storage bag 34 in FIG. 1. Alternatively, a banknote which has been recognized by the recognition unit 26 and determined by the control unit 50 as being a banknote to be collected by a staff of an armored car service or the like, is transported by the primary transport unit 24 to the right-side banknote storage bag 34 in FIG. 1.

Next, a description will be given of the operation of the banknote storage mechanism 32 to store banknotes transported by the secondary transport unit 25 from the upper unit 14 to the lower unit 16, into the banknote storage bag 34, with reference to FIGS. 5 to 10. In FIGS. 5 to 9, banknotes stored in the banknote storage bag 34 are represented by a reference character P.

In replacing the banknote storage bag 34 in the lower unit 16, when an empty banknote storage bag 34 is set and held by the pair of holding members 36 in the banknote storage mechanism 32, the control unit 50 controls the pantograph 47 so that the pressing plate 46 advances into the banknote storage bag 34 and presses the bottom portion of the banknote storage bag 34 toward the stages 40. This operation will be described below in detail.

FIG. 5 is a side view illustrating the state where banknotes are stored in the banknote storage bag 34 before the bottom portion of the banknote storage bag 34 is pressed from inside by the pressing plate 46 in the banknote storage mechanism 32 shown in FIG. 2 etc. As shown in FIG. 5, after an empty banknote storage bag 34 has been set and held by the pair of holding members 36 in the banknote storage mechanism 32, if banknotes are stored in the banknote storage bag 34 before the bottom portion of the banknote storage bag 34 has been pressed from inside by the pressing plate 46, since the bottom portion of the banknote storage bag 34 positioned above the stages 40 is not shaped to be flat, the banknotes stacked on the bottom portion of the banknote storage bag 34 when being stored in the banknote storage bag 34 are tilted with respect to the horizontal direction as represented by the reference character P in FIG. 5. This results in an unstable stacked state of the banknotes in the banknote storage bag 34.

Figure 6:
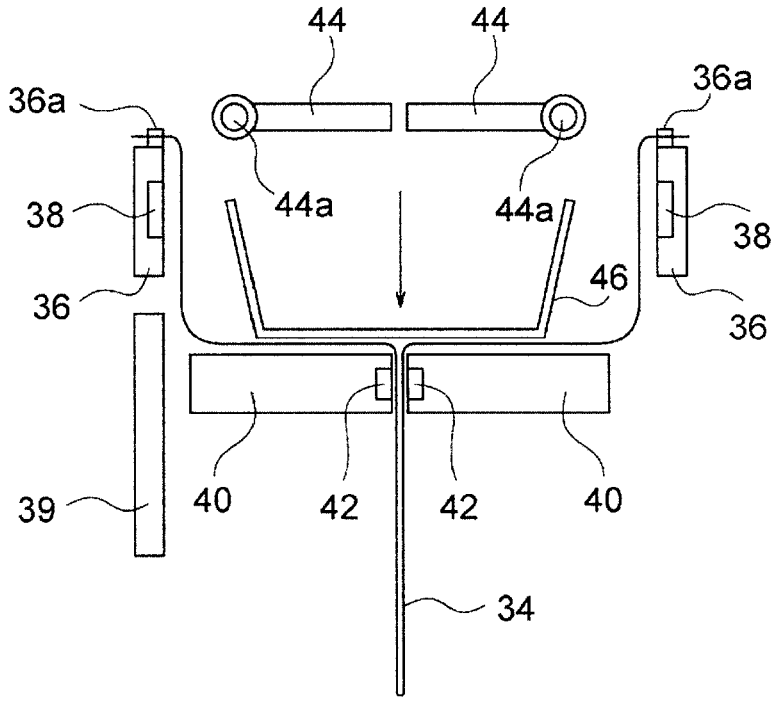
FIG. 6 is a side view illustrating an operation of pressing, by the pressing plate, the bottom portion of the banknote storage bag from inside in the banknote storage mechanism shown in FIG. 2, etc.
Figure 7:
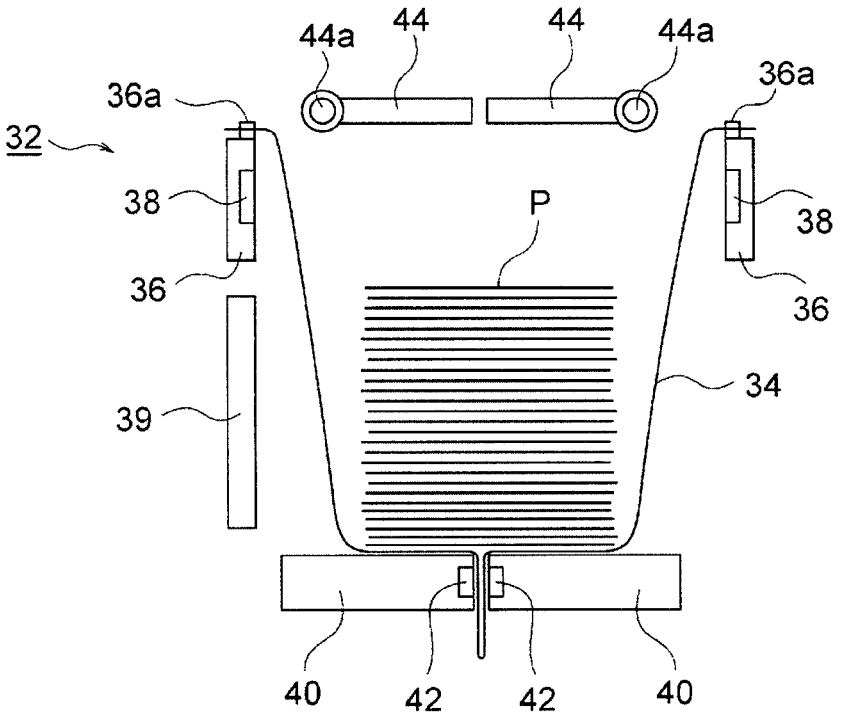
FIG. 7 is a side view, subsequent to the state shown in FIG. 6, illustrating an operation of storing banknotes in the banknote storage bag in the banknote storage mechanism shown in FIG. 2, etc.

In contrast, according to the present invention, after an empty banknote storage bag 34 is set and held by the pair of holding members 36 in the banknote storage mechanism 32, the pressing plate 46 is caused to advance into the empty banknote storage bag 34 and press the bottom portion of the banknote storage bag 34 toward the stages 40 as shown in FIG. 6, whereby the portion of the banknote storage bag 34 placed on the stages 40 (i.e., the bottom portion of the banknote storage bag 34) is brought into a state in which banknotes are stackable thereon. The "state in which banknotes are stackable" is a state where the bottom portion of the banknote storage bag 34 is flat or substantially flat. Thus, the bottom portion of the banknote storage bag 34 can be formed in advance into a shape that enables stacking of banknotes (specifically, a flat shape). Therefore, as shown in FIG. 7, the banknotes stacked on the bottom portion of the banknote storage bag 34, when being stored in the banknote storage bag 34, are prevented from tilting with respect to the horizontal direction, thereby rendering the stacked state of banknotes in the banknote storage bag 34 stable. When the pressing plate 46 advances into the banknote storage bag 34 and presses the bottom portion of the banknote storage bag 34 from inside toward the stages 40, the bottom portion of the banknote storage bag 34 is sandwiched between the pressing plate 46 and the stages 40. The present embodiment is not limited to the mode described above. In another mode, when the pressing plate 46 advances into the banknote storage bag 34 held by the holding members 36 and presses the bottom portion of the banknote storage bag 34 from inside toward the stages 40, a small gap may be formed between the pressing plate 46 and the stages 40, and the bottom portion of the banknote storage bag 34 may be caught in this small gap so that the bottom portion of the banknote storage bag 34 is formed in a flat shape.

Next, a brief description will be given of the operation of the banknote storage mechanism 32 to store the banknotes transported by the secondary transport unit 25 from the upper unit 14 to the lower unit 16, into the banknote storage bag 34 being held by the pair of holding members 36. Each banknote transported by the secondary transport unit 25 from the upper unit 14 to the lower unit 16 is sent to the pair of right and left escrow units 44 by the banknote sending unit 48, and is stacked on the escrow units 44. When a predetermined number of banknotes are stacked on the escrow units 44, each escrow unit 44 is rotated downward (i.e., in the direction indicated by the arrow in FIG. 2), causing the banknotes stacked on the escrow units 44 to drop under their own weights from the escrow units 44 into the banknote storage bag 34. At this time, since the bottom portion of the banknote storage bag 34 has been pre-formed into a flat shape as described above, when the banknotes drop from the escrow units 44 into the banknote storage bag 34, the banknotes stacked on the bottom portion of the banknote storage bag 34 are prevented from tilting with respect to the horizontal direction. Once the banknotes have been dropped from the escrow unit 44 into the banknote storage bag 34, the stages 40 are moved downwards by the stage driving unit 41 so that a space for storing banknotes to be dropped subsequently from the escrow units 44 into the banknote storage bag 34 is created inside the banknote storage bag 34. Further, in the present embodiment, when the banknotes are transported and stored into the banknote storage bag 34, the control unit 50 controls the pantograph 47 so that the pressing plate 46 pushes the banknotes temporarily escrowed on the escrow units 44 into the banknote storage bag 34. Thus, even when banknotes remain on the escrow units 44, the remaining banknotes can still be dropped from the escrow units 44 into the banknote storage bag 34.

In the present embodiment, after the banknotes are stored in the banknote storage bag 34 and the stages 40 are moved downwards, the control unit 50 may control the pantograph 47 so that the pressing plate 46 advances into the banknote storage bag 34 and presses the bottom portion of the banknote storage bag 34 toward the stages 40 via the banknotes stacked in the banknote storage bag 34. In this case, even during the operation to store the banknotes into the banknote storage bag 34, a portion of the banknote storage bag 34 placed on the stages 40 (i.e., the bottom portion of the banknote storage bag 34) is brought into a state where banknotes are stackable thereon (specifically, a flat state or a substantially flat state), whereby the bottom portion of the banknote storage bag 34 can be newly formed into a shape that enables stacking of banknotes (specifically, a flat shape). Therefore, the banknotes stacked in the banknote storage bag 34 are more reliably prevented from tilting with respect to the horizontal direction, whereby the stacked state of the banknotes in the banknote storage bag 34 can be made more stable.

When the banknotes are stored in the banknote storage bag 34, an image of the marker 34*c* provided on the inner wall portion of the banknote storage bag 34 is taken continuously by the imaging unit 60. When a predetermined amount of banknotes have been stored in the banknote storage bag 34, the marker 34*c* is blocked by the banknotes stored in the banknote storage bag 34 and does not appear in the image taken by the imaging unit 60. At this time, the control unit 50 determines that the banknote storage bag 34 is in the full state or the near-full state. Thus, the upper end position of the banknotes stored in the banknote storage bag 34 can be detected on the basis of the images taken by the imaging unit 60. Therefore, when the left-side holding member 36 is moved towards the right-side holding member 36 and the opening of the banknote storage bag 34 is heat-sealed by the heating member 38 as described later, it is possible to avoid the situation that some of the banknotes stored in the banknote storage bag 34 are caught by the holding members 36 causing only partial sealing at the opening of the banknote storage bag 34.

When it is determined that the banknote storage bag 34 is in the full state or the near-full state, the banknote storage bag 34 is taken out of the banknote storage mechanism 32. Before the banknote storage bag 34 is taken out of the banknote storage mechanism 32, as shown in FIG. 8, the aligning lever 39 is moved to the right in FIG. 8 by the aligning lever driving unit 39*a*, so that the banknotes stored in the banknote storage bag 34 are pushed to one side (specifically, to the right in FIG. 8) by the aligning lever 39 from the outside of the banknote storage bag 34. Thereafter, when the aligning lever 39 is returned to the position as shown in FIG. 2, a gap is formed between the left-side inner wall portion of the banknote storage bag 34 and the banknotes aligned to one side in the banknote storage bag 34. This gap, when the left-side holding member 36 is moved toward the right-side holding member 36 as described later, prevents the left-edge portion of the topmost banknote among the plurality of banknotes stored in the banknote storage bag 34 from rolling upward due to the left-side inner wall portion of the banknote storage bag 34.

After the banknotes are aligned to one side (specifically, to the right in FIG. 8) in the banknote storage bag 34, the left-side stage 40 is moved toward the right-side stage 40, and heat is applied by the heating members 42 to a portion of the banknote storage bag 34 near the bottom portion thereof, with the stages 40 abutting one another other as shown in FIG. 2, whereby the bottom portion of the banknote storage bag 34 is heat-sealed. Thereafter, the left-side holding member 36 is moved toward the right-side holding member 36 in FIG. 2, and heat is applied by the heating members 38 to a portion of the banknote storage bag 34 near the opening thereof, with the holding members 36 abutting one another, causing the opening of the banknote storage bag 34 to be heat-sealed, as shown in FIG. 9. Thus, the operator is then able to remove the banknote storage bag 34 having the sealed opening and the sealed bottom portion from the banknote storage mechanism 32.

After an empty banknote storage bag 34 is set and held by the pair of holding members 36, each stage 40 may be moved in a direction indicated by an arrow in FIG. 10 before the pressing plate 46 is caused to advance into the banknote storage bag 34 (i.e., the empty banknote storage bag 34) and press the bottom portion of the banknote storage bag 34 toward the stages 40.

More specifically, when no banknote storage bag 34 is held by the holding members 36 in the banknote storage mechanism 32, each of the pair of stages 40 is located at a stand-by position indicated by a reference character A in FIG. 10. When a banknote storage bag 34 is set and held by the pair of holding members 36, each stage 40 is moved upwardly by the stage driving unit 41 to a position indicated by a reference character B in FIG. 10. Then, the stages 40 are moved by the stage driving unit 41 so as to approach each other, with a portion of the banknote storage bag 34 being sandwiched between the stages 40. Thus, each stage 40 reaches a position indicated by a reference character C in FIG. 10, and the sandwiched portion of the banknote storage bag 34 is narrowed by the stages 40. When each stage 40 is located at the position indicated by the reference character C in FIG. 10, the pressing plate 46 is moved downward by the pantograph 47 so that the pressing plate 46 advances into the banknote storage bag 34 and presses the bottom portion of the banknote storage bag 34 toward the stages 40. Thus, the portion of the banknote storage bag 34 placed on the stages 40 (i.e., the bottom portion of the banknote storage bag 34) is brought into a state where banknotes are stackable thereon (specifically, a flat state or a substantially flat state). Thereafter, the pressing plate 46 is moved upwards and retracted to the outside of the banknote storage bag 34. After the pressing plate 46 has been retracted, each stage 40 is further moved upward by the stage driving unit 41 to a position indicated by a reference character D in FIG. 10. The amount of the upward movement of each stage 40 is about 10 mm, for example. By moving the stages 40 upward after the pressing plate 46 has pressed the bottom portion of the banknote storage bag 34, the bottom portion of the banknote storage bag 34 can be brought into the state in which banknotes are stackable thereon (specifically, a flat state or a substantially flat state) more reliably, whereby the bottom portion of the banknote storage bag 34 can be formed into a shape that enables stacking of banknotes (specifically, a flat shape) more reliably.

Alternatively, instead of moving the stages 40 as shown in FIG. 10, after the stages 40 are moved upward to a lower-limit position of the pressing plate 46, the pressing plate 46 may be moved downward by the pantograph 47 so that the pressing plate 46 advances into the banknote storage bag 34 and presses the bottom portion of the banknote storage bag 34 toward the stages 40. In this case, even after the pressing plate 46 is moved upward and retracted to the outside of the banknote storage bag 34, the stages 40 are not further moved upward.

According to the banknote handling machine 10 of the present embodiment configured as described above and the banknote storage mechanism 32 provided in the banknote handling machine 10, before transporting banknotes to the inside of the banknote storage bag 34 held by the holding members 36, the control unit 50 controls the pantograph 47 so that the pressing plate 46 advances into the banknote storage bag 34 and presses the bottom portion of the banknote storage bag 34 toward the stages 40. By causing the pressing plate 46 to advance into the banknote storage bag 34 and press the bottom portion of the banknote storage bag 34 toward the stages 40, the portion of the banknote storage bag 34 placed on the stages 40 is brought into a state where banknotes are stackable thereon (specifically, a flat state or a substantially flat state), whereby the bottom portion of the banknote storage bag 34 can be formed into a shape that enables stacking of banknotes (specifically, a flat shape) in advance. Thus, the banknotes stacked on the bottom portion of the banknote storage bag 34, when being stored in the banknote storage bag 34, are prevented from tilting with respect to the horizontal direction, whereby the stacked state of the banknotes in the banknote storage bag 34 can be made stable.

The pair of escrow units 44 for temporarily escrowing the banknotes before being stored in the banknote storage bag 34 held by the holding members 36 are provided as described above, and the escrow units 44 temporarily escrow the banknotes sent from the banknote sending unit 48. Further, when the banknotes are transported to the inside of the banknote storage bag 34, the control unit 50 controls the pantograph 47 so that the pressing plate 46 pushes the banknotes temporarily escrowed on the escrow units 44 into the banknote storage bag 34. In this case, the single pressing plate 46 can realize both the function of pushing the banknotes escrowed on the escrow units 44 into the banknote storage bag 34 and the function of forming the bottom portion of the banknote storage bag 34 into a shape that enables stacking of banknotes in advance.

After the banknotes are transported into the banknote storage bag 34 held by the holding members 36, the control unit 50 controls the pantograph 47 so that the pressing plate 46 advances into the banknote storage bag 34 and presses the bottom portion of the banknote storage bag 34 toward the stages 40 via the banknotes stacked in the banknote storage bag 34. In this case, even during the operation to store the banknotes into the banknote storage bag 34, a portion of the banknote storage bag 34 placed on the stages 40 (i.e., the bottom portion of the banknote storage bag 34) is brought into a state where banknotes are stackable thereon (specifically, a flat state or a substantially flat state), whereby the bottom portion of the banknote storage bag 34 can be newly formed into a shape that enables stacking of banknotes (specifically, a flat shape).

After the pressing plate 46 is caused to advance into the banknote storage bag 34 held by the holding members 36 and press a portion of the banknote storage bag 34 toward the stages 40, the control unit 50 controls the stage driving unit 41 so as to move the stages 40 upward (i.e., so as to move each stage 40 from the position indicated by the reference character C to the position indicated by the reference character D in FIG. 10). In this case, by further moving the stages 40 upward after the bottom portion of the banknote storage bag 34 is pressed by the pressing plate 46, the bottom portion of the banknote storage bag 34 can be brought into the state where banknotes are stackable thereon (specifically, a flat state or a substantially flat state) more reliably, whereby the bottom portion of the banknote storage bag 34 can be formed into a shape that enables stacking of banknotes (specifically, a flat shape) more reliably.

When the pressing plate 46 advances into the banknote storage bag 34 held by the holding members 36 and presses the bottom portion of the banknote storage bag 34 from inside toward the stages 40, the bottom portion of the banknote storage bag 34 is compressed between the pressing plate 46 and the stages 40. Alternatively, when the pressing plate 46 advances into the banknote storage bag 34 held by the holding members 36 and presses the bottom portion of the banknote storage bag 34 from inside toward the stages 40, a small gap may be formed between the pressing plate 46 and the stages 40.

Each holding member 36 is provided with the heating member 38 (first heating member) that seals, by thermal adhesion, the portion of the banknote storage bag 34, near the opening, held by the holding members 36. In this case, the second holding member 36 is caused to move towards the first holding member 36 so that the first and second holding members 36 abut one another. Heat is applied by the heating member 38 to the portion of the banknote storage bag 34, near the opening, causing the opening of the banknote storage bag 34 to be heat-sealed. However, the first and second holding members 36 need not both have the heating member 38. The heating member 38 may be provided in only one of the first and second holding members 36.

The stages 40 are provided as described above, and each stage 40 is movable in a direction towards and away from the other stage 40. In the state where a portion of the banknote storage bag 34 is positioned in the gap between the mutually spaced stages 40, the pressing plate 46 advances into the banknote storage bag 34 and presses the banknote storage bag 34 from inside toward the stages 40, causing the portion of the banknote storage bag 34 placed on the stages 40 to be brought into the state where banknotes are stackable thereon. By providing the gap between the pair of stages 40, the banknote storage bag 34 is easily moved when the pressing plate 46 advances into the banknote storage bag 34 and presses the banknote storage bag 34 from inside, causing the banknote storage bag 34 to be easily brought into the state where banknotes are stackable thereon. In addition, before causing the pressing plate 46 to advance into the banknote storage bag 34, the control unit 50 causes the stages 40 to move in a direction towards each other, with a portion of the banknote storage bag 34 being positioned between the mutually spaced stages 40, thereby sandwiching the portion of the banknote storage bag 34 between the stages 40. Thus, the portion of the banknote storage bag 34 can be narrowed by the stages 40.

Each stage 40 is provided with the heating member 42 (second heating member) that seals, by thermal adhesion, a portion, near the stages 40, of the banknote storage bag 34 held by the holding members 36 (i.e., the bottom portion of the banknote storage bag 34). In this case, after one of the stages 40 is moved toward the other stage 40, the heating member 42 applies heat to the bottom portion of the banknote storage bag 34, with these stages 40 abutting one another, thereby causing the bottom portion of the banknote storage bag 34 to be heat-sealed. The stages 40 need not both have a heating member 42. The heating member 42 may be provided in only one of the stages 40.

The banknote handling machine 10 and the banknote handling method according to the present embodiment are not limited to the modes described above, and various modification can be devised.

Figure 12:
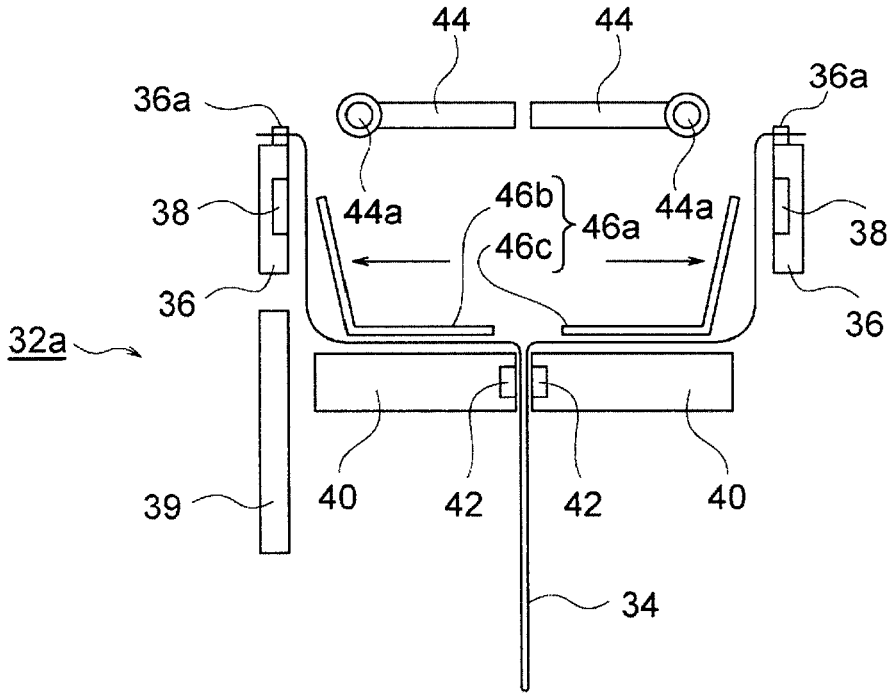
FIG. 12 is a side view illustrating, in detail, the structure of a banknote storage mechanism in a second embodiment.

For example, while the banknote storage mechanism 32 of the banknote handling machine 10 shown in FIGS. 1 to 11 uses a single pressing plate 46, a banknote storage mechanism 32*a* shown in FIG. 12 may use a pressing plate 46*a* composed of a pair of right and left pressing parts 46*b* and 46*c* which are spaced apart from each other. In the banknote storage mechanism 32*a* shown in FIG. 12, after the pressing plate 46*a* advances into the banknote storage bag 34, the right and left pressing parts 46*b* and 46*c* move to spread outwardly within the banknote storage bag 34 (refer to arrows in FIG. 12). According to the banknote storage mechanism 32*a*, the portion, placed on the stages 40, of the banknote storage bag 34 held by the holding members 36 (i.e., the bottom portion of the banknote storage bag 34) can be brought into the state in which banknotes are stackable thereon (specifically, a flat state or a substantially flat state) more reliably.

Figure 13:
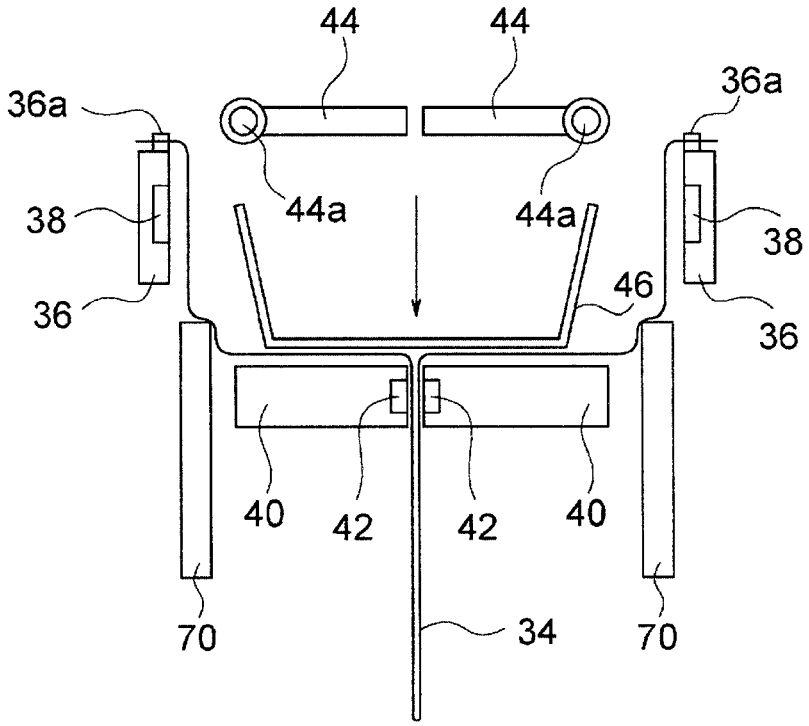
FIG. 13 is a side view illustrating, in detail, the structure of a banknote storage mechanism in a third embodiment.

In a banknote storage mechanism according to another modification, as shown in FIG. 13, a pair of regulation guides 70 may be provided outside the respective stages 40 and below the respective holding members 36. The respective regulation guides 70 are movable in mutually approaching and separating directions. That is, the regulation guides 70 are movable in the right-left direction in FIG. 13. These regulation guides 70 regulate the side surfaces of the banknote storage bag 34 when a lot of banknotes are stored in the banknote storage bag 34 and the stages 40 move downward from the state as shown in FIG. 13.

Each regulation guide 70 has a plate shape having a large width corresponding to the width of the banknote storage bag 34. The shape of the regulation guide 70 is not limited to the plate shape with a large width. Each regulation guide 70 may be composed of a plurality of plate-shaped members, each having a small width, arranged side by side so as to correspond to the width of the banknote storage bag 34. Alternatively, each regulation guide 70 may be composed of a plurality of rod-like members arranged side by side so as to correspond to the width of the banknote storage bag 34. The respective regulation guides 70 are movable in the right-left direction in FIG. 13 by driving mechanisms (not shown). Moving the regulation guides 70 by the driving mechanisms allows the distance between the opposing right and left regulation guides 70 to be adjusted according to the width of the banknotes stored in the banknote storage bag 34. Instead of providing two driving mechanisms corresponding to the respective regulation guides 70, only one of the regulation guides 70 may be driven by a single driving mechanism. In this case, while the position of one of the regulation guides 70 is fixed, the other regulation guide 70 is moved toward the fixed regulation guide 70. In another example, the positions of the respective regulation guides 70 may be fixed in accordance with a banknote having the largest size among various kinds of banknotes to be stored in the banknote storage bag 34. That is, the respective regulation guides 70 may not be movable in the right-left direction in FIG. 13.

As described above, the side surfaces of the banknote storage bag 34 are regulated by the regulation guides 70 when a lot of banknotes are stored in the banknote storage bag 34 held by the holding members 36 and the stages 40 move downward from the state shown in FIG. 13. Thus, even if the height of the banknotes stored in the banknote storage bag 34 is increased, collapse of the banknotes in the banknote storage bag 34 is avoided.

In addition to the pair of right and left regulation guides 70, regulation guides of the same structure as the regulation guides 70 may be provided at the front and rear sides of the banknote storage bag 34 in the surface of the sheet of FIG. 13. In this case, since the entire periphery of the banknote storage bag 34 can be regulated by the pair of right and left regulation guides 70 and the regulation guides provided at the front and rear sides of the banknote storage bag 34, collapse of the banknotes in the banknote storage bag 34 can be more reliably avoided.

The dimension of the stages 40 is designed in accordance with a banknote having the smallest size among various kinds of banknotes to be stored in the banknote storage bag 34. Even when the banknote having the smallest size is stored in the banknote storage bag 34, the stages 40 and the regulation guides 70 do not interfere with each other. When a plurality of plate-shaped members, each having a small width, arranged side by side or a plurality of rod-like members arranged side by side are used as each regulation guide 70, cutout portions, through which the plate-shaped members or the rod-like members pass, may be provided in the stages 40 in order to make the stages 40 and the regulation guides 70 cross each other. In this case, the dimension of the stages 40 can be made larger than the width of the banknote.

One of the pair of right and left regulation guides 70 may be used as an aligning lever for aligning, to one side in the banknote storage bag 34, the banknotes stored in the banknote storage bag 34 held by the pair of holding members 36. That is, one of the pair of right and left regulation guides 70 may be configured to perform the same operation as the aligning lever 39 shown in FIGS. 5 to 9.

Figure 14:
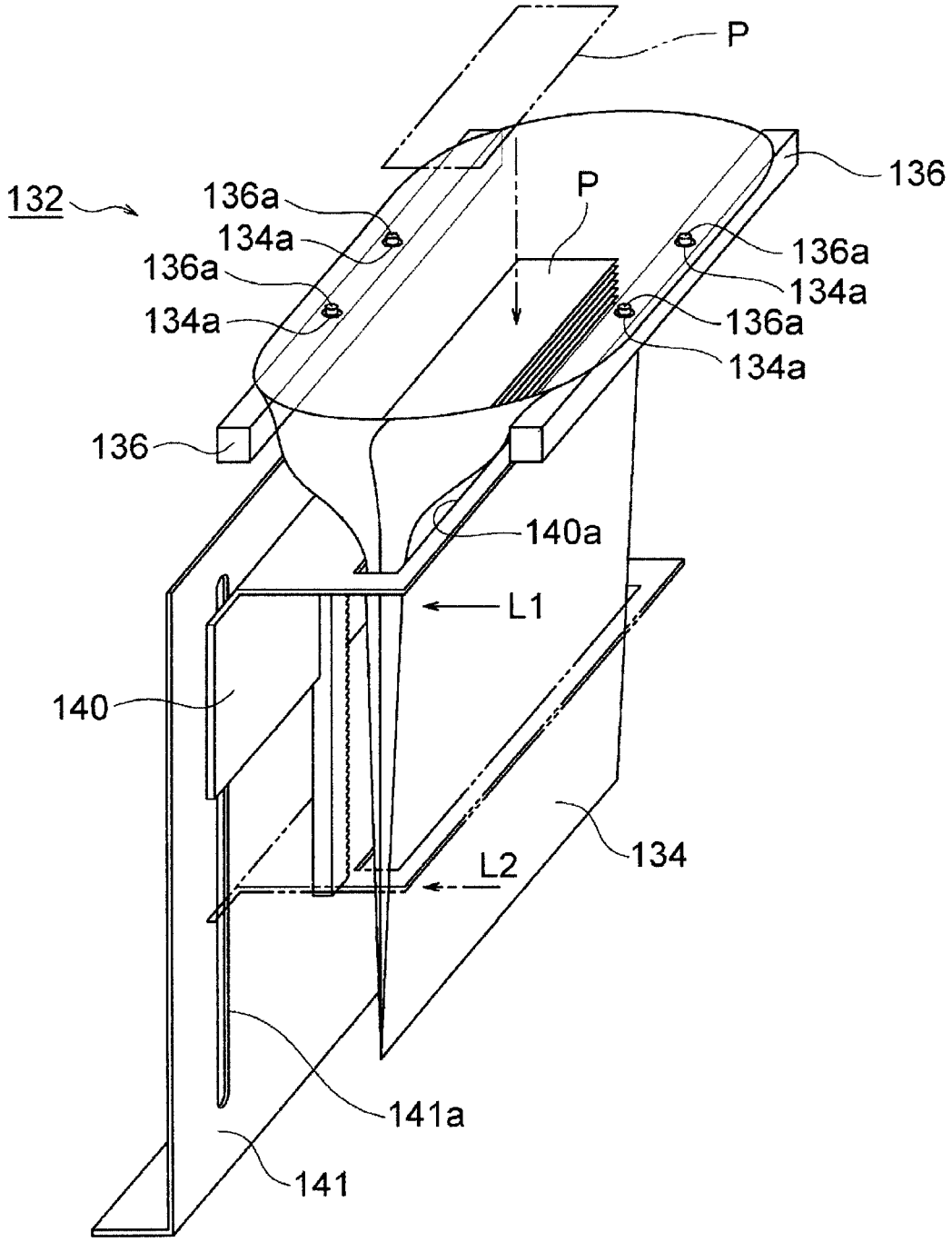
FIG. 14 is a perspective view illustrating the structure of a banknote storage mechanism in a fourth embodiment, in a state where a stage is at an upper-limit position.
Figure 15:
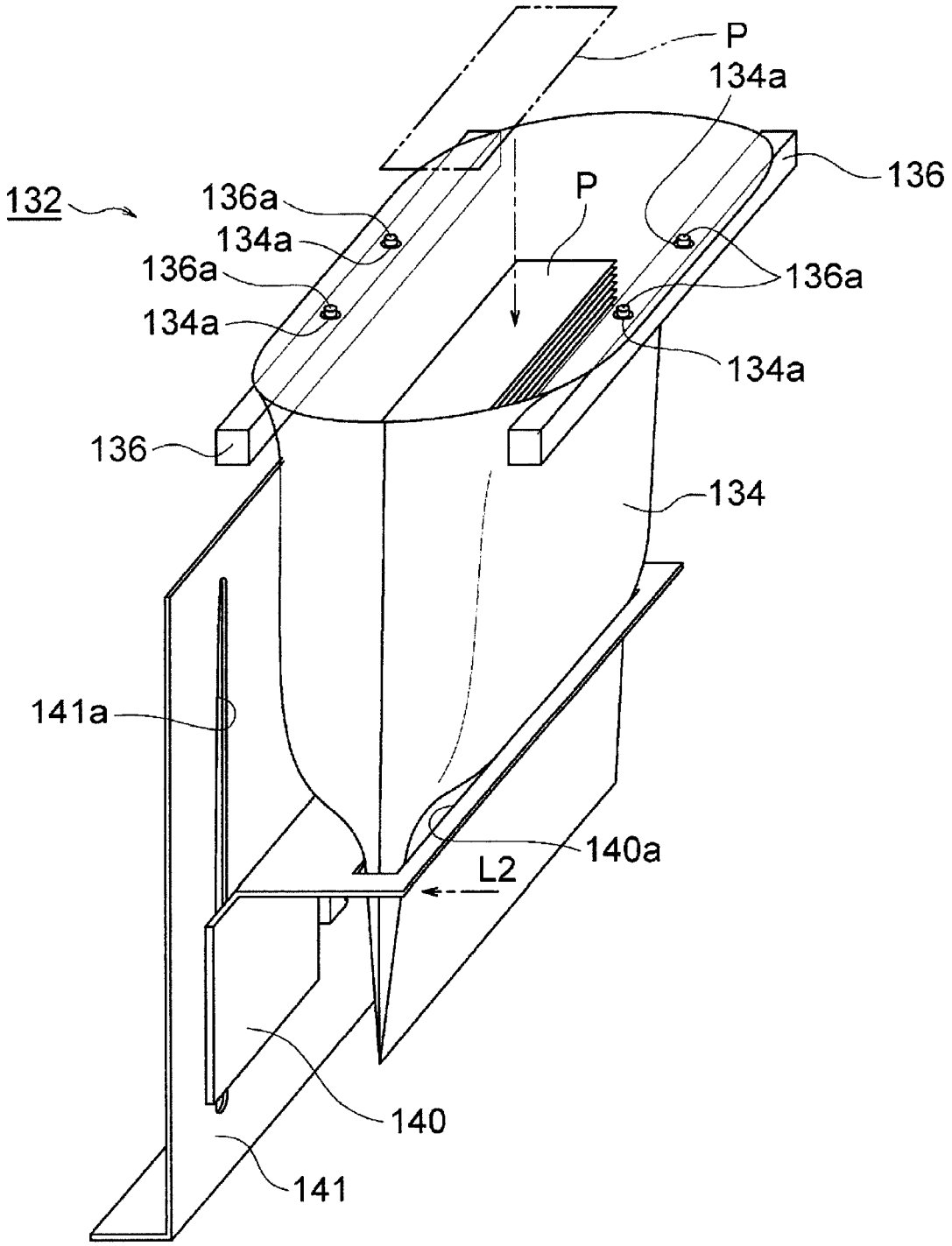
FIG. 15 is a perspective view illustrating the structure of the banknote storage mechanism shown in FIG. 14, in a state where the stage is at a lower-limit position.
Figure 16:
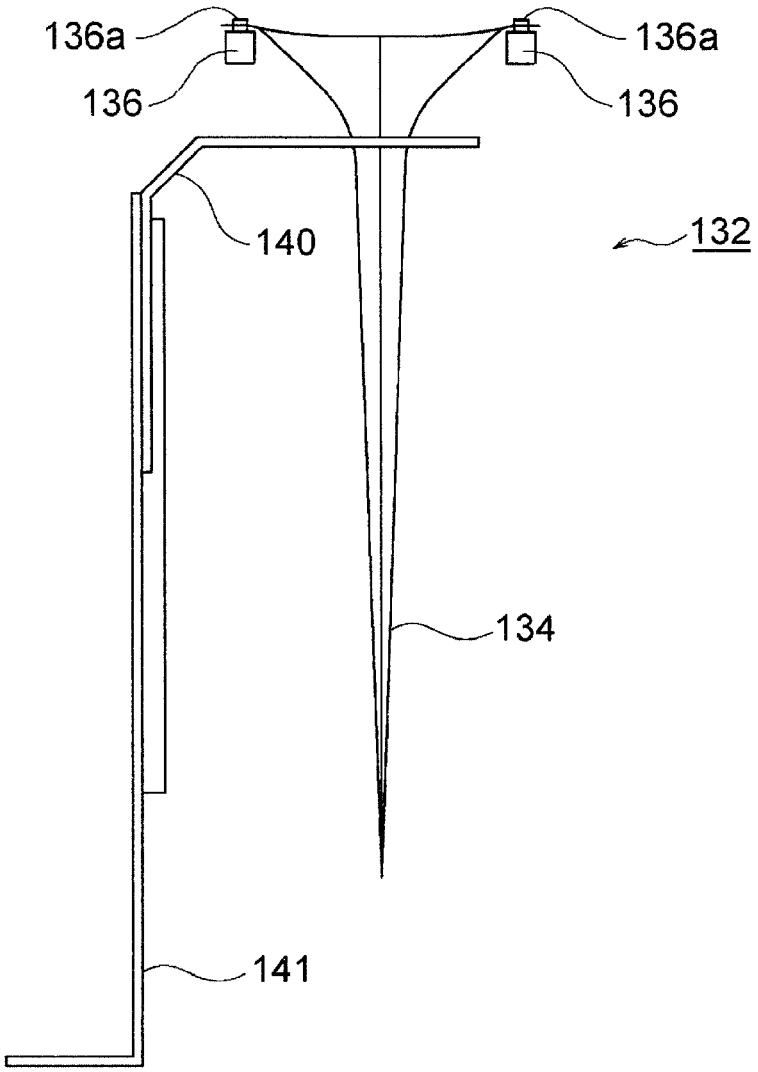
FIG. 16 is a side view illustrating the structure of the banknote storage mechanism shown in FIG. 14, in a state where the stage is at the upper-limit position.
Figure 17:
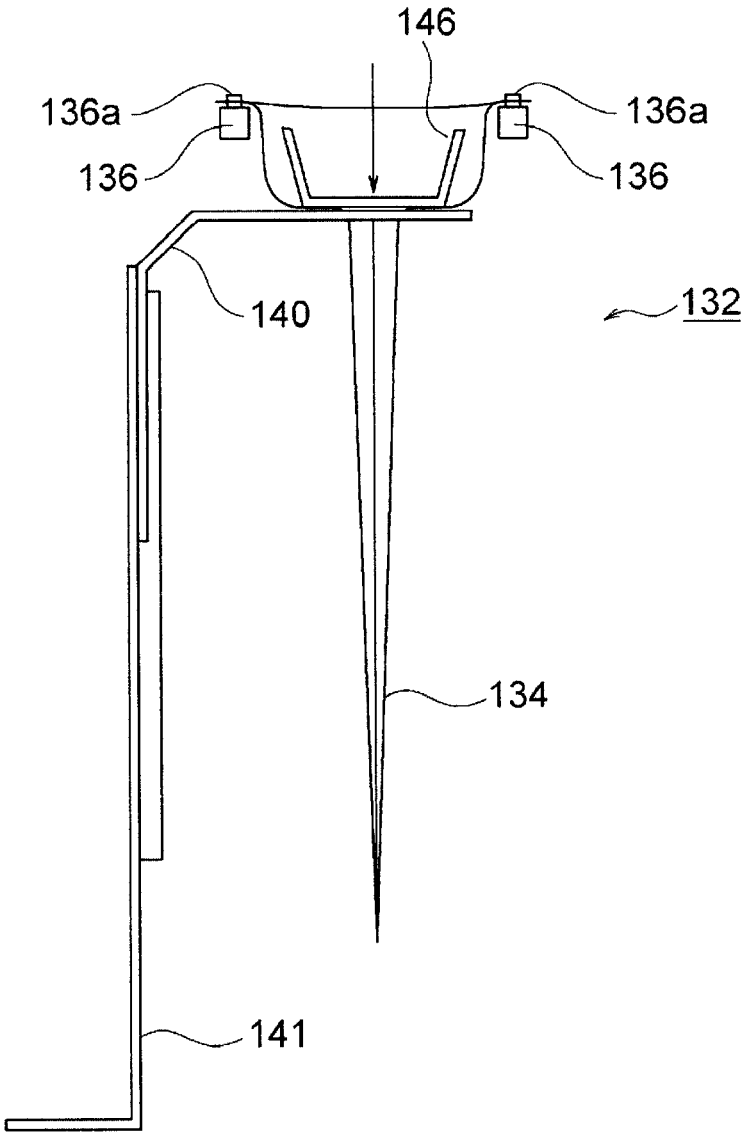
FIG. 17 is a side view illustrating the structure of the banknote storage mechanism shown in FIG. 14, in a state where a bottom portion of a banknote storage bag is pressed from inside by a pressing plate.
Figure 18:
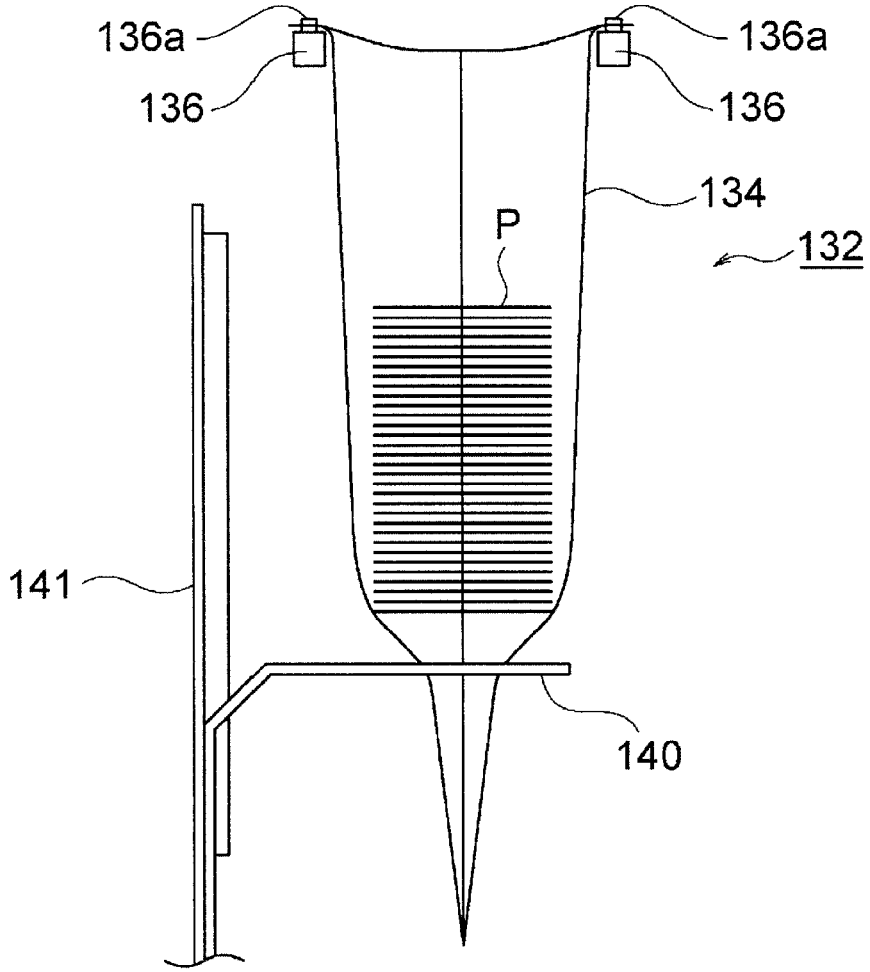
FIG. 18 is a side view illustrating the structure of the banknote storage mechanism of FIG. 14, in a state where the stage is at the lower-limit position.

Still another banknote storage mechanism may have the structure as shown in FIGS. 14 to 18. FIG. 14 is a perspective view illustrating the structure of a banknote storage mechanism 132 according to another modification, in a state where a stage 140 is at an upper-limit position. FIG. 15 is a perspective view illustrating the structure of the banknote storage mechanism 132 shown in FIG. 14, in a state where the stage 140 is at a lower-limit position. FIG. 16 is a side view illustrating the structure of the banknote storage mechanism 132 shown in FIG. 14, in a state where the stage 140 is at the upper-limit position. FIG. 17 is a side view illustrating the structure of the banknote storage mechanism 132 shown in FIG. 14, in a state where a bottom portion of a banknote storage bag 134 is pressed from inside by a pressing plate 146. FIG. 18 is a side view illustrating the structure of the banknote storage mechanism 132 shown in FIG. 14, in a state where the stage 140 is at the lower-limit position. In FIGS. 14 to 18, banknotes stored in the banknote storage bag 134 are represented by a reference character P.

As shown in FIGS. 14 to 18, the banknote storage mechanism 132 according to the other modification is provided with a pair of holding members 136 which are spaced apart from and opposed to each other, and two opposing portions, of the banknote storage bag 134, near an opening thereof are held by the respective holding members 136. While the position of one holding member 136 (specifically, the right-side holding member 136 in FIGS. 14 to 18) is fixed, the other holding member 136 (specifically, the left-side holding member 136 in FIGS. 14 to 18, for example) is movable toward the fixed holding member 136. Each holding member 136 is provided with a heating member (not shown). After a predetermined amount of banknotes have been stored in the banknote storage bag 134 provided in the banknote storage mechanism 132, before the banknote storage bag 134 is taken out of the banknote storage mechanism 132, one of the holding members 136 is moved toward the other holding member 136, and the heating members apply heat to a portion of the banknote storage bag 134 near the opening thereof, with the holding members 136 being joined to each other, whereby the opening of the banknote storage bag 134 is heat-sealed.

In the banknote storage mechanism 132 according to another modification, escrow units (not shown) are provided above the respective holding members 136, and banknotes are temporarily escrowed on the escrow units before being stored in the banknote storage bag 134. Further, a pressing plate 146 is provided above the escrow units. The pressing plate 146 is provided with a pantograph (not shown), and the pantograph when expanding downwardly causes the pressing plate 146 to move downwards from the position above the escrow units. When the banknotes temporarily escrowed on the escrow units are stored in the banknote storage bag 134, the pressing plate 146 moving downward pushes banknotes remaining on the escrow units toward the banknote storage bag 134.

As shown in FIGS. 14 and 15, two pins 136*a* are provided on each of the upper surfaces of the pair of right and left holding members 136. A plurality of (four in the example shown in FIG. 14, etc.) holes 134*a* are provided in a portion, near the opening, of the banknote storage bag 134 to be held by the holding members 136 (i.e., an upper end portion of the banknote storage bag 134). The pins 136*a* of the holding members 136 stick through the holes 134*a* of the banknote storage bag 134, whereby the banknote storage bag 134 is held by the holding members 136.

The banknote storage mechanism 132 is provided with the stage 140 on which the bottom portion of the banknote storage bag 134 held by the pair of holding members 136 is placed. The stage 140 has an opening 140*a*, and a portion of the banknote storage bag 134 held by the holding members 136 extends downward from the stage 140 through the opening 140*a*. The stage 140 is movable in the up-down direction in FIG. 14, etc. More specifically, a guide member 141 extending in the vertical direction is provided near the stage 140, and the stage 140 is movable in the up-down direction along the guide member 141. Specifically, the stage 140 is provided with a guide pin (not shown), and the guide member 141 has a linear elongate slot 141*a* in which the guide pin is guided. The elongate slot 141*a* extends in the vertical direction. The guide pin provided on the stage 140 being guided along the elongated hole 141*a* allows the stage 140 to move in the up-down direction along the guide member 141. In the banknote storage mechanism 132 shown in FIGS. 14 to 18, the stage 140 is movable between an upper-limit position indicated by a reference character L1 and a lower-limit position indicated by a reference character L2 in FIG. 14.

Also in the banknote storage mechanism 132 shown in FIGS. 14 to 18, like the banknote storage mechanism 32 shown in FIGS. 1 to 11, when replacement of banknote storage bag 134 is performed, after an empty banknote storage bag 134 is set and held by the pair of holding members 136 in the banknote storage mechanism 132, the pressing plate 146 (refer to FIG. 17) is caused to advance into the banknote storage bag 134 held by the holding members 136 and press the bottom portion of the banknote storage bag 134 toward the stage 140. This operation will be described later in detail.

FIG. 16 is a side view illustrating the state of the banknote storage mechanism 132 shown in FIG. 14, etc. before the bottom portion of the banknote storage bag 134 is pressed by the pressing plate 146 from inside, after an empty banknote storage bag 134 has been set and held by the pair of holding members 136. In the banknote storage mechanism 132, after the empty banknote storage bag 134 is set and held by the pair of holding members 136, if banknotes are stored in the banknote storage bag 134 before the bottom portion of the banknote storage bag 134 is pressed by the pressing plate 146 from inside, since the bottom portion of the banknote storage bag 134 positioned above the stage 140 is not yet shaped to be flat as shown in FIG. 16, the banknotes stacked on the bottom portion of the banknote storage bag 134 are tilted with respect to the horizontal direction when being stored in the banknote storage bag 134, which may result in a risk of an unstable stacked state of the banknotes in the banknote storage bag 134.

In contrast to the above, the banknote storage mechanism 132 shown in FIGS. 14 to 18 has advantages as follows. That is, after the empty banknote storage bag 134 is set and held by the pair of holding members 136 in the banknote storage mechanism 132, the pressing plate 146 is caused to advance into the banknote storage bag 134 (i.e., the empty banknote storage bag 134) held by the holding members 136 and press the bottom portion of the banknote storage bag 134 against the stage 140 as shown in FIG. 17, whereby a portion of the banknote storage bag 134 placed on the stage 140 (i.e., the bottom portion of the banknote storage bag 134) is brought into a state where banknotes are stackable thereon (specifically, a flat state or a substantially flat state). Thus, the bottom portion of the banknote storage bag 34 can be pre-formed into a shape that enables stacking of banknotes (specifically, a flat shape). Therefore, as shown in FIG. 18, the banknotes stacked on the bottom portion of the banknote storage bag 134, when being stored in the banknote storage bag 134, are prevented from tilting with respect to the horizontal direction, thereby causing the stacked state of the banknotes in the banknote storage bag 134 to be made stable. When the pressing plate 146 advances into the banknote storage bag 134 held by the holding members 136 and presses the bottom portion of the banknote storage bag 134 from inside toward the stage 140, the bottom portion of the banknote storage bag 134 is compressed between the pressing plate 146 and the stage 140. In another mode, when the pressing plate 146 advances into the banknote storage bag 134 held by the holding members 136 and presses the bottom portion of the banknote storage bag 134 from inside toward the stage 140, a small gap may be formed between the pressing plate 146 and the stage 140, and the bottom portion of the banknote storage bag 134 may be caught in this small gap to form the bottom portion of the banknote storage bag 134 into a shape that enables stacking of banknotes (specifically, a flat shape).

Next, the operation of the banknote storage mechanism 132 to store banknotes in the banknote storage bag 134 held by the pair of holding members 136 will be briefly described. As indicated by two-dot chain lines in FIG. 14 and FIG. 15, banknotes transported to the banknote storage mechanism 132 are dropped under their own weight from above into the banknote storage bag 134. At this time, since the bottom portion of the banknote storage bag 134 is formed into a shape that enables stacking of banknotes (specifically, a flat shape) in advance as described above, banknotes stacked on the bottom portion of the banknote storage bag 134 are prevented from tilting with respect to the horizontal direction when being dropped and stored in the banknote storage bag 134. Further, every time banknotes are stored in the banknote storage bag 134, the stage 140 is moved downwards, thereby creating a space inside the banknote storage bag 134 for storing banknotes to be transported subsequently thereto.

Thereafter, when the stage 140 is moved to the lower-limit position as shown in FIG. 15 and FIG. 18, it is determined that the banknote storage bag 34 is in the full state or the near-full state, and the banknote storage bag 134 is taken out of the banknote storage mechanism 132. More specifically, when it is determined that the banknote storage bag 34 is in the full state or the near-full state, the left-side holding member 136 in FIG. 14, etc. is moved toward the right-side holding member 136, and heat is applied from the heating member to the portion of the banknote storage bag 134, near the opening, with the holding members 136 abutting one another, causing the opening of the banknote storage bag 134 to be heat-sealed. Thus, the operator is able to take out the banknote storage bag 134 with the sealed opening from the banknote storage mechanism 132.

Also in the banknote storage mechanism 132 as shown in FIGS. 14 to 18, like the banknote storage mechanism 32 as shown in FIGS. 1 to 11, before banknotes are transported into the banknote storage bag 134 held by the holding members 136, the pressing plate 146 is caused to advance into the banknote storage bag 134 and press the bottom portion of the banknote storage bag 134 toward the stage 140. Thus, a portion of the banknote storage bag 134 placed on the stage 140 can be brought into a state where banknotes are stackable thereon (specifically, a flat state or a substantially flat state), whereby the bottom portion of the banknote storage bag 134 can be formed into a shape that allows stacking of banknotes (specifically, a flat shape) in advance. Therefore, the banknotes stacked on the bottom portion of the banknote storage bag 134 when being stored in the banknote storage bag 134 are prevented from tilting with respect to the horizontal direction. Thus, the stacked state of the banknotes in the banknote storage bag 134 can be made stable.

The paper sheet handling machine according to the present invention and the paper sheet storage mechanism provided in the paper sheet handling machine are not limited to the banknote handling machine 10 that performs various kinds of handling such as depositing of banknotes, and the banknote storage mechanism 32, 132, or the like provided in the banknote handling machine 10. As a paper sheet handling machine and a paper sheet storage mechanism according to the present invention, those capable of handling paper sheets such as checks or gift coupons other than banknotes may be used.

The invention claimed is:

1. A paper sheet storage mechanism for storing paper sheets into a storage bag having an opening at one end thereof, the paper sheet storage mechanism comprising:

a holding unit configured to hold an upper portion, near the opening, of the storage bag;

a paper sheet sending unit configured to send paper sheets;

an escrow unit configured to stack, thereon, the paper sheets sent from the paper sheet sending unit and to transfer, therefrom, the paper sheets stacked thereon to the storage bag held by the holding unit;

a stage configured to be movable in a vertical direction, and on which a first portion of the storage bag held by the holding unit is placed;

a pressing unit configured to advance into the storage bag held by the holding unit and press the placed first portion of the storage bag toward the stage; and a control unit configured to control the paper sheet storage mechanism such that the pressing unit moves to outside of the storage bag after the pressing unit advances into the held empty storage bag and presses the placed first portion of the empty storage bag and before the stage moves upward from a lower position to an upper position.

2. The paper sheet storage mechanism according to claim 1, wherein the control unit is configured to control the paper sheet storage mechanism such that the pressing unit pushes the paper sheets stacked on the escrow unit into the empty storage bag to transfer the paper sheets from the escrow unit into the held empty storage bag after the stage moves upward from the lower position to the upper position.

3. The paper sheet storage mechanism according to claim 2, wherein the control unit is configured to control the paper sheet storage mechanism such that the pressing unit advances into the held storage bag with the paper sheets stacked within and presses the placed first portion of the storage bag toward the stage via the paper sheets stacked in the storage bag after the pressing unit pushes the paper sheets stacked on the escrow unit into the held empty storage bag.

4. The paper sheet storage mechanism according to claim 1, wherein when the pressing unit advances into the empty storage bag held by the holding unit and presses the placed first portion of the empty storage bag from inside toward the stage, the placed first portion of the empty storage bag is compressed between the pressing unit and the stage.

5. The paper sheet storage mechanism according to claim 1, wherein the holding unit includes a first heating member configured to seal, by thermal adhesion, the upper portion, near the opening, of the storage bag held by the holding unit.

6. The paper sheet storage mechanism according to claim 1, wherein the pressing unit includes a plurality of pressing parts, and the respective pressing parts, after advancing into the empty storage bag held by the holding unit, move to spread outwardly within the empty storage bag, so that the paper sheets sent from the paper sheet sending unit are stackable on the bottom portion of the empty storage bag placed on the placement unit.

7. The paper sheet storage mechanism according to claim 1, wherein the stage includes a first stage and a second stage which have a gap through which a second portion of the storage bag held by the holding unit is capable of being inserted.

8. The paper sheet storage mechanism according to claim 7, wherein the first stage is movable in a first direction where the first stage approaches the second stage and in a second direction where the first stage moves away from the second stage, wherein the control unit is configured to control the paper sheet storage mechanism such that the pressing unit advances into the held empty storage bag and presses the placed first portion of the empty storage bag toward the stage when the second portion of the empty storage bag held by the holding unit is positioned in the gap.

9. The paper sheet storage mechanism according to claim 8, wherein the control unit is configured to control the paper sheet storage mechanism such that the pressing unit advances into the held empty storage bag and presses the placed first portion of the empty storage bag toward the stage after first stage moves in the first with the second portion of the empty storage bag being positioned at the gap to sandwich the second portion of the empty storage bag between the first and second stages.

10. The paper sheet storage mechanism according to claim 8, wherein at least one of the first and second stages includes a second heating member configured to seal, by thermal adhesion, the second portion, of the storage bag held by the holding unit.

11. A paper sheet storage mechanism for storing paper sheets into a storage bag having an opening at one end thereof, the paper sheet storage mechanism comprising:

a holding unit configured to hold an upper portion, near the opening, of the storage bag;

a paper sheet sending unit configured to send paper sheets;

an escrow unit configured to stack, thereon, the paper sheets sent from the paper sheet sending unit and to transfer, therefrom, the paper sheets stacked thereon to the storage bag held by the holding unit;

a stage configured to be movable in a vertical direction, and on which a first portion of the storage bag held by the holding unit is placed;

a pressing unit configured to advance into the storage bag held by the holding unit and press the placed first portion of the storage bag toward the stage; and a control unit configured to control the paper sheet storage mechanism such that after an empty storage bag has been held by the holding unit and before paper sheets are sent into the held empty storage bag by the paper sheet sending unit, the pressing unit advances into the held empty storage bag and presses the first portion of the empty storage bag placed on the stage toward the stage, and thereafter the stage moves upward from a lower position to an upper position wherein the control unit is also configured to control the paper sheet storage mechanism such that the pressing unit moves to outside of the storage bag after the pressing unit advances into the held empty storage bag and presses the placed first portion of the empty storage bag and before the stage moves upward from a lower position to an upper position.

* * * * *